US011197546B2

(12) United States Patent
Meusburger et al.

(10) Patent No.: US 11,197,546 B2
(45) Date of Patent: Dec. 14, 2021

(54) SECURING DEVICE FOR DETACHABLY SECURING A FRONT PANEL ON A DRAWER

(71) Applicant: Julius Blum GmbH, Hoechst (AT)

(72) Inventors: Marc Meusburger, Egg (AT); Gerald Sperger, Hard (AT); Markus Irgang, Altach (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 16/865,670

(22) Filed: May 4, 2020

(65) Prior Publication Data

US 2020/0260868 A1 Aug. 20, 2020

Related U.S. Application Data

(63) Continuation of application No. PCT/AT2018/060238, filed on Oct. 8, 2018.

(30) Foreign Application Priority Data

Nov. 7, 2017 (AT) ..... A 50932/2017

(51) Int. Cl.
*A47B 88/95* (2017.01)
*A47B 88/956* (2017.01)

(52) U.S. Cl.
CPC ..... *A47B 88/95* (2017.01); *A47B 88/956* (2017.01); *A47B 2088/954* (2017.01)

(58) Field of Classification Search
CPC . A47B 88/95; A47B 88/956; A47B 2088/951; A47B 2088/952;

(Continued)

(56) References Cited

U.S. PATENT DOCUMENTS 8,297,724 B2 10/2012 Hämmerle
8,727,461 B2 * 5/2014 Holzapfel ..... A47B 88/956 312/348.4

(Continued)

FOREIGN PATENT DOCUMENTS

CA 2886160 A1 * 5/2016 ..... A47B 88/956
CN 103561609 2/2014

(Continued)

OTHER PUBLICATIONS

International Search Report dated Dec. 19, 2018 in International (PCT) Application No. PCT/AT2018/060238.

*Primary Examiner* — Andrew M Roersma
(74) *Attorney, Agent, or Firm* — Wenderoth, Lind & Ponack, L.L.P.

(57) ABSTRACT

A securing device includes a furniture fitting configured to be premounted on a front panel; a catch device associated with the drawer and configured to receive the furniture fitting and automatically pull the furniture fitting; a locking device configured to prevent the furniture fitting from unintentionally becoming detached from the securing device; and a coupling device for coupling movement of the locking device to movement of the catch device. The coupling device includes an adjusting body and an adjusting contour in or on which the adjusting body is or can be arranged. The adjusting body is arranged on the catch device, and the adjusting contour on the locking device, or vice versa, and the adjusting contour is configured such that the movement of the locking device is initially uncoupled from the movement of the catch device during insertion of the furniture fitting. A securing device includes a furniture fitting premounted on the front panel; a catch device associated with the drawer for receiving the furniture fitting as it is inserted and pulling it automatically towards the drawer; a locking device that prevents the furniture fitting from unintentionally (Continued)

becoming detached from the securing device; and a coupling device for coupling the movement of the locking device to the movement of the catch device. The coupling device includes an adjusting body and an adjusting contour in or on which the adjusting body is or can be arranged. The adjusting body is arranged on the catch device, and the adjusting contour on the locking device, or vice versa, and the adjusting contour is designed such that the movement of the locking device is only temporarily coupled to the movement of the catch device during the insertion of the furniture fitting.

14 Claims, 14 Drawing Sheets

(58) Field of Classification Search
CPC ..... A47B 2088/953; A47B 2088/954; A47B 2088/955; A47B 2210/09
See application file for complete search history.

(56) References Cited

U.S. PATENT DOCUMENTS

| | | | | |
|---|---|---|---|---|
| 8,955,929 | B2 * | 2/2015 | Holzapfel | A47B 88/956 312/348.4 |
| 9,028,019 | B2 | 5/2015 | Holzapfel et al. | |
| 9,033,436 | B2 * | 5/2015 | Holzapfel | A47B 88/956 312/348.4 |
| 9,386,848 | B2 | 7/2016 | Holzapfel | |
| 9,464,652 | B2 | 10/2016 | Holzapfel et al. | |
| 10,010,174 | B2 | 7/2018 | Chen et al. | |
| 10,188,209 | B2 | 1/2019 | Hoffmann et al. | |
| 10,342,343 | B2 * | 7/2019 | Su | A47B 88/941 |
| 10,568,427 | B2 * | 2/2020 | Kruger | A47B 88/941 |
| 10,799,024 | B2 * | 10/2020 | Bektas | A47B 88/941 |
| 2010/0102692 | A1 | 4/2010 | Hämmerle | |
| 2014/0070687 | A1 | 3/2014 | Holzapfel et al. | |
| 2014/0072366 | A1 | 3/2014 | Holzapfel et al. | |
| 2014/0077677 | A1 | 3/2014 | Holzapfel et al. | |
| 2014/0252936 | A1 | 9/2014 | Holzapfel | |
| 2017/0135473 | A1 | 5/2017 | Chen et al. | |
| 2017/0265645 | A1 * | 9/2017 | Kruger | A47B 88/956 |
| 2018/0000242 | A1 | 1/2018 | Hoffmann et al. | |
| 2020/0054131 | A1 * | 2/2020 | Prentner | A47B 88/95 |

FOREIGN PATENT DOCUMENTS

| | | |
|---|---|---|
| CN | 103561610 | 2/2014 |
| CN | 204181227 | 3/2015 |
| CN | 106793871 | 5/2017 |
| DE | 20 2014 002 229 | 4/2014 |
| EP | 3 167 760 | 5/2017 |
| JP | 2010-532684 | 10/2010 |
| JP | 2014-515278 | 6/2014 |
| TW | 201635954 | 10/2016 |
| WO | 2009/006651 | 1/2009 |
| WO | 2012/159140 | 11/2012 |
| WO | 2012/171047 | 12/2012 |
| WO | 2013/075152 | 5/2013 |
| WO | 2016/015865 | 2/2016 |
| WO | 2016/145465 | 9/2016 |

* cited by examiner

SECURING DEVICE FOR DETACHABLY SECURING A FRONT PANEL ON A DRAWER

BACKGROUND OF THE INVENTION

The invention concerns a securing device, an arrangement comprising a drawer, a front panel, and at least one such securing device, and an article of furniture having at least one such arrangement. And finally the invention concerns a method of securing a front panel to a drawer.

Securing devices are known from the state of the art. A disadvantage of the existing securing devices is that they are stiff to move as frictional forces have to be overcome in a relative movement of the individual components with respect to each other. That impedes in particular the insertion of the at least one furniture fitting and reduces the service life of the securing devices.

SUMMARY OF THE INVENTION

The object of the present invention is to overcome the disadvantages of the state of the art and to provide a securing device which is improved over the state of the art and which in particular is distinguished by low frictional forces. A further object is to provide an arrangement having such an improved securing device as well as an article of furniture having at least one such arrangement. And finally a further object is to provide a method of securing a front panel to a drawer by means of a securing device which is improved according to the invention.

In regard to the securing device it is therefore provided that the coupling device has at least one adjusting body and at least one adjusting contour, in or on which the at least one adjusting body is or can be arranged, wherein the at least one adjusting body is arranged on the at least one catch device and the at least one adjusting contour is arranged on the at least one locking device, or vice-versa, and wherein the at least one adjusting contour is of such a configuration that the movement of the at least one locking device is only temporarily coupled to the movement of the at least one catch device upon insertion of the at least one furniture fitting.

By virtue of the only temporary coupling of the movement of the at least one locking device to the movement of the at least one catch device when inserting the at least one furniture fitting it is possible to move the at least one locking device only when it is also actually necessary. In the state of the art, the movement of the at least one catch device and the movement of the at least one locking device are permanently coupled together so that situations in the procedure can occur, in which one of those two devices is moved without serving a specific purpose. As a result, unnecessary frictional losses occur. In the present invention, the two devices can be moved as required, in comparison therewith. For example, it is possible to carry out a procedure in which the at least one furniture fitting is received by the at least one catch device and automatically pulled towards the drawer, wherein the movement of the at least one catch device and the movement of the at least one locking device are initially uncoupled and are then coupled together by way of the coupling device, therefore initially only the at least one catch device moves, whereas the at least one locking device remains substantially at rest, and then the at least one locking device moves in order to arrange it at the at least one furniture fitting and therefore to prevent unintentional release of the at least one furniture fitting from the securing device.

A simple way of ensuring that the at least one catch device pulls the at least one furniture fitting automatically towards the drawer in the insertion operation—in accordance with a preferred embodiment—, is that the securing device includes at least one spring and the at least one catch device upon insertion of the at least one furniture fitting automatically pulls same towards the drawer by the force of the at least one spring. Alternatively other drive mechanisms can also be provided.

In addition, it is appropriate that the at least one catch device is moveable into a readiness position in which the at least one catch device is ready to receive the at least one furniture fitting upon insertion thereof and into at least one drive position in which the at least one catch device pulls the at least one furniture fitting after it has been received automatically towards the drawer, preferably wherein the at least one catch device has a catch lever pivotable about an axis of rotation.

In regard to the at least one locking device it has been found to be particularly advantageous that the at least one locking device includes a preferably curved locking contour which can be arranged on the at least one furniture fitting to prevent unintended detachment of the at least one furniture fitting from the securing device, preferably wherein the at least one furniture fitting can be clamped by the locking contour, and/or the at least one locking device is moveable into a release position in which the at least one furniture fitting is moveable freely with respect to the at least one locking device and into a locking position in which unintended detachment of the at least one furniture fitting from the securing device is prevented, preferably wherein the at least one locking device has a locking lever pivotable about an axis of rotation.

In regard to the at least one adjusting body a particularly stable embodiment can be implemented by the at least one adjusting body being in the form of a pin, preferably with an enlarged head.

The at least one adjusting body is fixedly connected to the at least one catch device or the at least one locking device, at which it is arranged.

For coupling the movement of the at least one locking device to the movement of the at least one catch device when inserting the at least one furniture fitting, the at least one adjusting contour can have at least one coupling portion.

For uncoupling the movement of the at least one locking device from the movement of the at least one catch device when inserting the at least one furniture fitting, the at least one adjusting contour has at least one uncoupling portion separate from the coupling portion. The at least one coupling portion and the at least one uncoupling portion are angled relative to each other, or the at least one adjusting contour has an open end adjoining the at least one coupling portion. For the situation where the at least one uncoupling portion and the at least one coupling portion are angled relative to each other, it has been found to be advantageous if the at least one uncoupling portion and the at least one coupling portion include an angle of between 70° and 130°, preferably about 90°, relative to each other.

In order to predetermine the movement of the at least one adjusting body, the securing device can have at least one mounting plate, at least one guide contour can be formed in the at least one mounting plate, and the at least one adjusting body can be mounted displaceably in or on the at least one guide contour.

It has further been found to be advantageous if the at least one furniture fitting has at least one securing element for mounting the at least one furniture fitting to the front panel, and/or a transverse pin or a projection which cooperates with the at least one catch device and/or the at least one locking device.

It has also proven to be advantageous for the at least one furniture fitting to be of an asymmetrical configuration in relation to a notional central plane. In that way, it is possible for the front panel to be supported in the optimum fashion and at the same time to provide a compact structural configuration for the securing device. In addition, by virtue of that measure it is possible to use the at least one furniture fitting universally for different front panel heights.

Further preferred embodiments provide that the securing device has an unlocking device for the at least one locking device, which permits intentional release of the at least one furniture fitting from the securing device. The unlocking device withdraws the at least one locking device from the at least one furniture fitting and releases the at least one furniture fitting, preferably wherein the unlocking device has a tool receiving means accessible from the exterior for a tool, by way of which tool receiving means the unlocking device is actuable, and/or a height adjusting device and/or a side adjusting device for the front panel.

As stated in the opening part of this specification protection is also claimed on the one hand for an arrangement comprising a drawer, a front panel and at least one securing device according to the invention for detachably securing the front panel to the drawer. Preferably, the drawer includes at least one at least region-wise hollow drawer side wall, and the at least one securing device is arranged for the predominant part in the at least one drawer side wall and on the other hand for an article of furniture having at least one such arrangement.

According to the method according to the invention of securing a front panel to a drawer, in particular to a drawer side wall, by means of at least one securing device according to the invention, in a first method step at least one furniture fitting is mounted to the front panel, and in a second method step the at least one furniture fitting is received by the at least one catch device and automatically pulled towards the drawer. The movement of the at least one catch device and the movement of the at least one locking device are initially uncoupled and are then coupled together by way of the coupling device. In a third method step, unintentional detachment of the at least one furniture fitting from the securing device is prevented by means of the at least one locking device.

BRIEF DESCRIPTION OF THE DRAWINGS

Further details and advantages of the invention are described more fully hereinafter by means of the specific description with reference to the drawings in which.

DETAILED DESCRIPTION OF THE INVENTION

Figure 1:
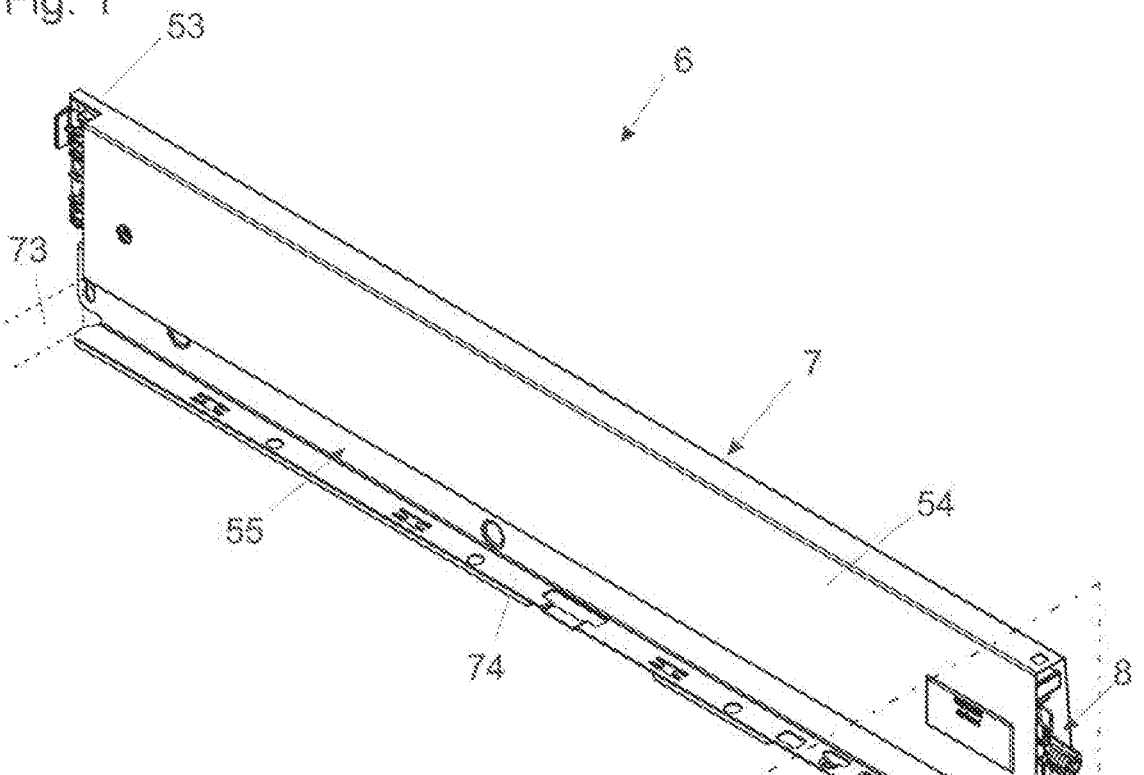
FIG. 1 is a perspective view of a drawer side wall together with an indicated drawer bottom and an indicated front panel.

FIG. 1 shows a drawer side wall 7 which includes a decorative profile 54 which is of a U-shaped configuration at least region-wise and a drawer rail 55, wherein the decorative profile 54 is fitted on to the drawer rail 55. The drawer rail 55 has a support flange 74 on which a drawer bottom 73, shown in broken line, can be arranged.

A dash-dotted line indicates a front panel 5, to which a furniture fitting 8 is mounted. That furniture fitting 8 is part of a securing device 1 (see the following Figures) for detachably securing the front panel 5 to the drawer 6. The furniture fitting 8 has two securing elements 47 in the form of expansion dowels.

Arranged at the opposite end of the drawer side wall 7 is a rear wall holder 53 for holding a drawer rear wall.

Figure 2A:
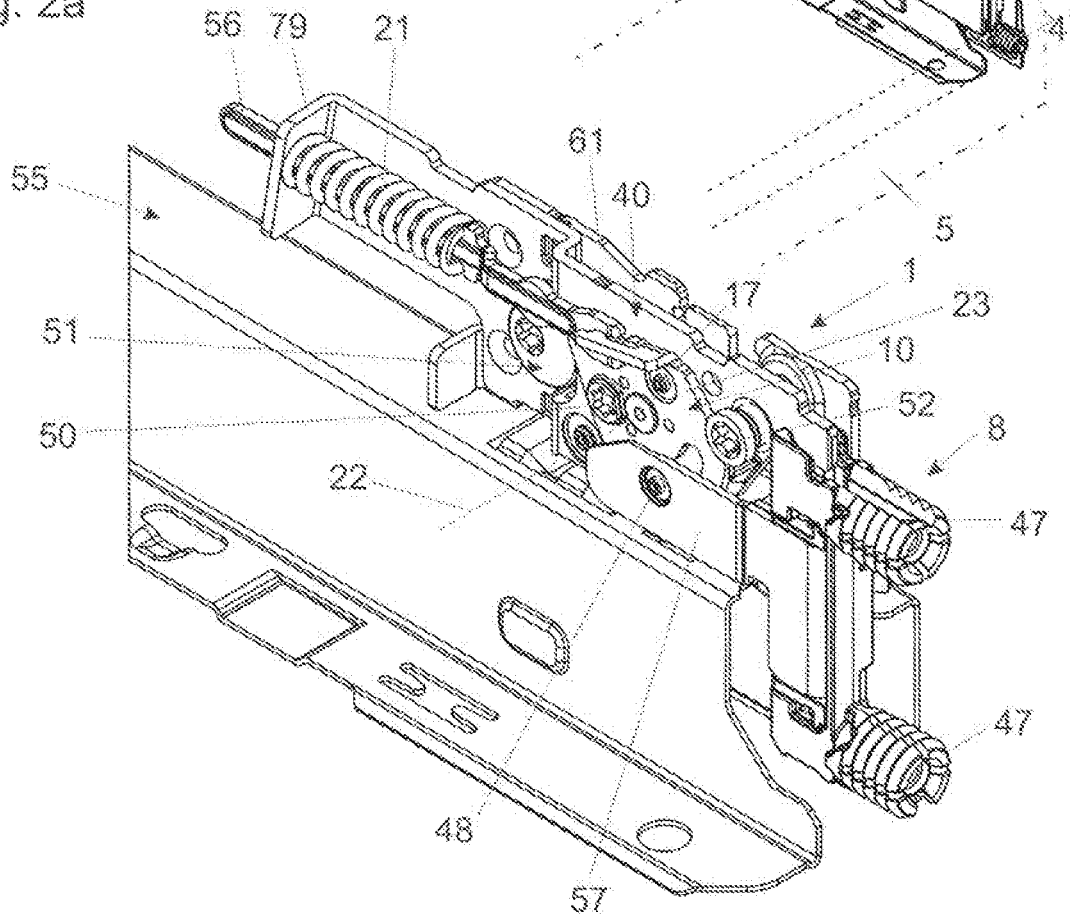
FIGS. 2*a*-2*c* show a first embodiment of the securing device as a perspective view, viewed from the drawer interior (FIG. 2*a*), from the opposite side (FIG. 2*b*) and as an exploded view (FIG. 2*c*)

In FIG. 2*a* the front region of the drawer side wall 7, that is towards the front panel 5, is to be seen in an enlarged view, with the decorative profile 54 having been omitted.

Figure 2B:
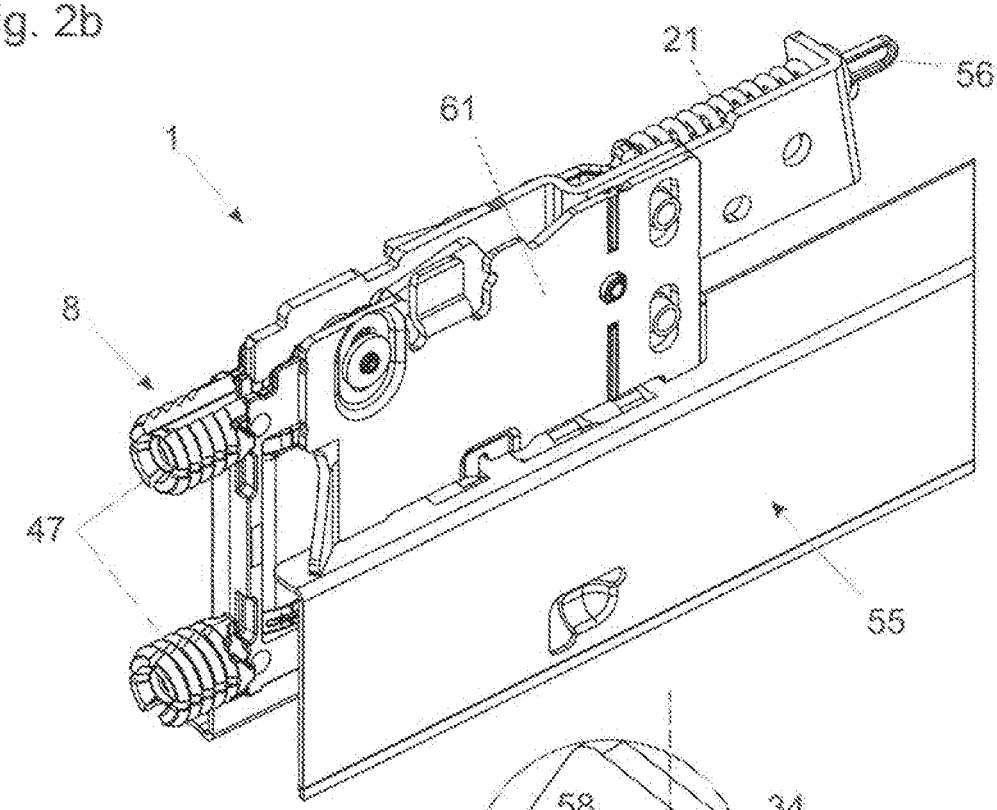

As will be seen a large part of the securing device 1 is arranged on the drawer rail 55. As can be seen from this and the two following FIGS. 2*b* and 2*c* the securing device 1, besides the furniture fitting 8 which can be pre-mounted to the front panel 5, includes a catch device 10 which is associated with the drawer 6 and which receives the furniture fitting upon insertion thereof and automatically pulls it towards the drawer 6, a locking device 13 which is separate from the catch device 10 and which prevents unintentional release of the furniture fitting 8 from the securing device 1 and a coupling device 17, 18 for coupling the movement of the locking device 13 to the movement of the catch device 10.

The coupling device 17, 18 has an adjusting body 17 and an adjusting contour 18 in which the adjusting body 17 is arranged, wherein the adjusting body 17 is arranged on the catch device 10 and the adjusting contour 18 is arranged on the locking device 13. A reversed arrangement of the adjusting body 17 and the adjusting contour 18 on the locking device 13 and the catch device 10 would be equally well possible.

The adjusting body 17 is in the form of a pin or bolt, having an enlarged head in the illustrated embodiment.

The adjusting contour 18 is of such a configuration that the movement of the locking device 13 upon insertion of the furniture fitting 8 is only temporarily coupled to the movement of the catch device 10. For that purpose, the adjusting contour 18 has a coupling portion 34, by way of which the movement of the locking device 13 upon insertion of the furniture fitting 8 can be coupled to the movement of the catch device 10 (compare the portion on an enlarged scale of the locking device 13 in FIG. 2*c*). In addition, the adjusting contour 18 has an uncoupling portion 37 separate from the coupling portion 34 for uncoupling the movement of the locking device 13 from the movement of the catch device 10 upon insertion of the furniture fitting 8. In the illustrated embodiment the coupling portion 34 and the uncoupling portion 37 are angled relative to each other. They include an angle 58 of about 90°.

The securing device 1 includes a spring 21. Upon insertion of the furniture fitting 8 the catch device 10 automatically pulls the furniture fitting 8 towards the drawer 6 by the force of the spring 21. In the illustrated embodiment the spring 21 is in the form of a compression spring. The spring 21 is further arranged on a spring guide 56 and is supported at a supporting contour 79 of a mounting plate 40 of the securing device 1.

A guide contour 44 in which the adjusting body 17 is displaceably mounted is also provided in the mounting plate 40.

Besides the mounting plate 40 there is also a cover plate 61. That has been omitted in most of the following Figures in order to permit a view of the locking device 13 which is arranged between the mounting plate 10 and the cover plate 61.

The catch device 10 has a catch lever 23 pivotable about an axis of rotation 22 (see FIG. 2*a*). The lever is acted upon directly by the spring 21 in the illustrated embodiment.

The locking device 13 has a locking lever 31 pivotable about an axis of rotation 30.

In addition the locking device 13 includes a locking contour 26 which can be arranged on the furniture fitting 8 to prevent unintentional release of the furniture fitting 8 from the securing device 1. In the present embodiment the locking contour 26 is of a curved contour. As can be seen for example from FIGS. 6*a* and 6*b* the furniture fitting 8 can be clamped by the locking contour 26.

Figure 2C:
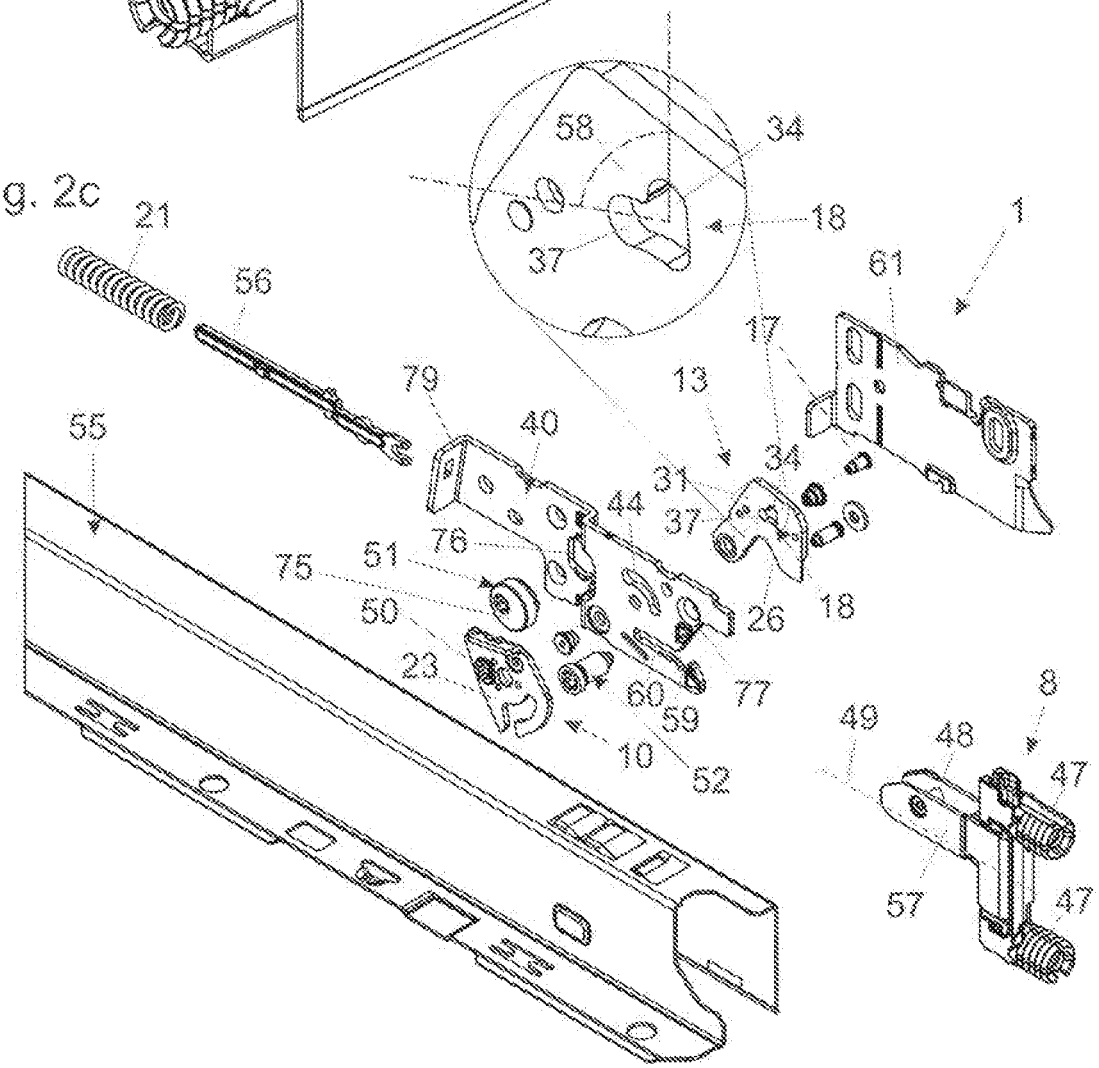

As can be seen in particular from FIG. 2*c* the furniture fitting 8 includes a U-shaped profile 57 in which a transverse pin 48 is arranged. In the present embodiment the furniture fitting 8 cooperates with the catch device 10 and the locking device 13 by way of that transverse pin 48. The following Figures respectively show only that transverse pin 48 of the furniture fitting 8.

The transverse pin 48 further cooperates with a guide contour 60 provided in the mounting plate 40. At the end towards the front panel 5 the guide contour 60 has a fitting engagement contour 59 which facilitates positioning of the front panel 5 and the furniture fitting 8 arranged thereon in relation to the other components of the securing device 1. That is advantageous in particular in relation to very heavy front panels 5.

In addition the furniture fitting 8 is of an asymmetrical configuration in relation to a notional central plane 49 (see FIG. 2*c*).

The securing device 1 further includes an unlocking device 50 for the locking device 13, wherein the unlocking device 50 permits intentional release of the furniture fitting 8 from the securing device 1, and wherein the unlocking device 50 withdraws the locking device 13 from the furniture fitting 8 and releases the furniture fitting 8. In the present embodiment the unlocking device 50 has a tool receiving means which is accessible from the outside for a tool, for example a screwdriver, by way of which the unlocking device 50 can be actuated.

In addition, the securing device 1 has a height adjusting device 51 with which the height of the front panel 5 can be adjusted relative to the drawer side wall 7 or the drawer 6. In the illustrated embodiment the height adjusting device 51 includes a eccentric screw with a rounded triangular contour 75 which is supported against a supporting contour 76 on the mounting plate 40.

And finally, the securing device 1 also includes a side adjusting device 52 in order to be able to adjust the lateral position of the front panel 5 relative to the drawer side wall 7 or the drawer 6. In the illustrated embodiment the side adjusting device 52 includes a screw having a thread which is supported at an opening 77 in the mounting plate 40.

Figure 3A:
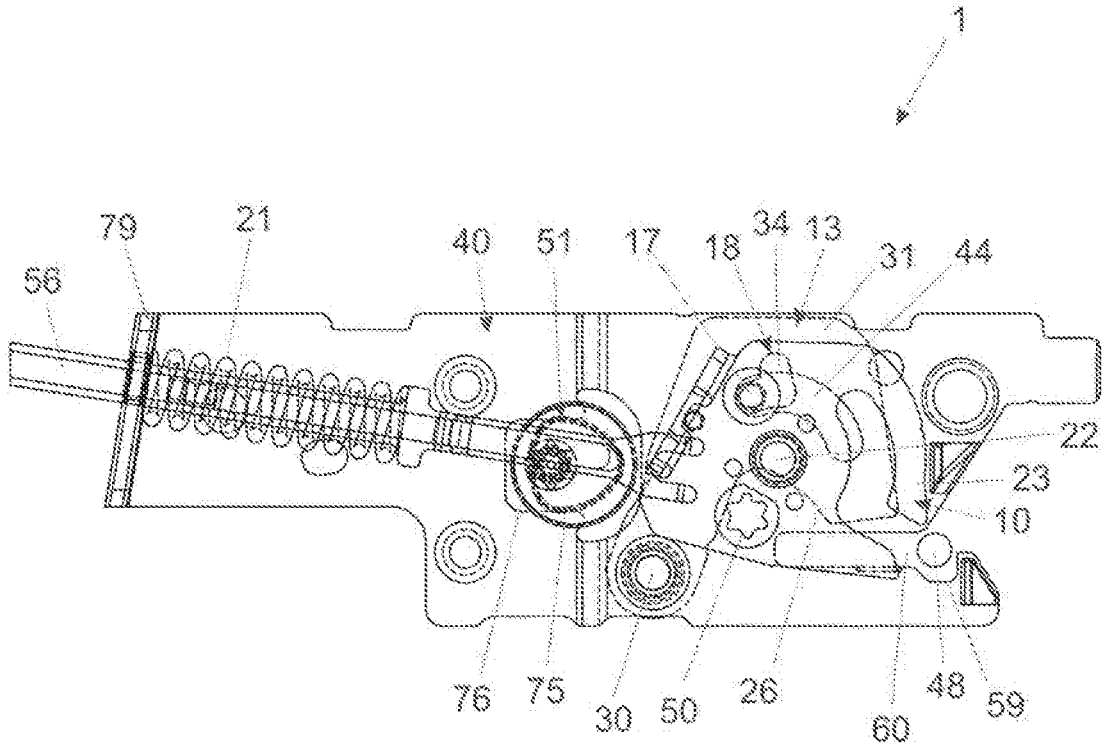
FIGS. 3*a*, 3*b* show a part of the securing device according to the first embodiment as a plan view from a first side (FIG. 3*a*) and from a second opposite side (FIG. 3*b*) in a position prior to insertion of a furniture fitting.
Figure 3B:
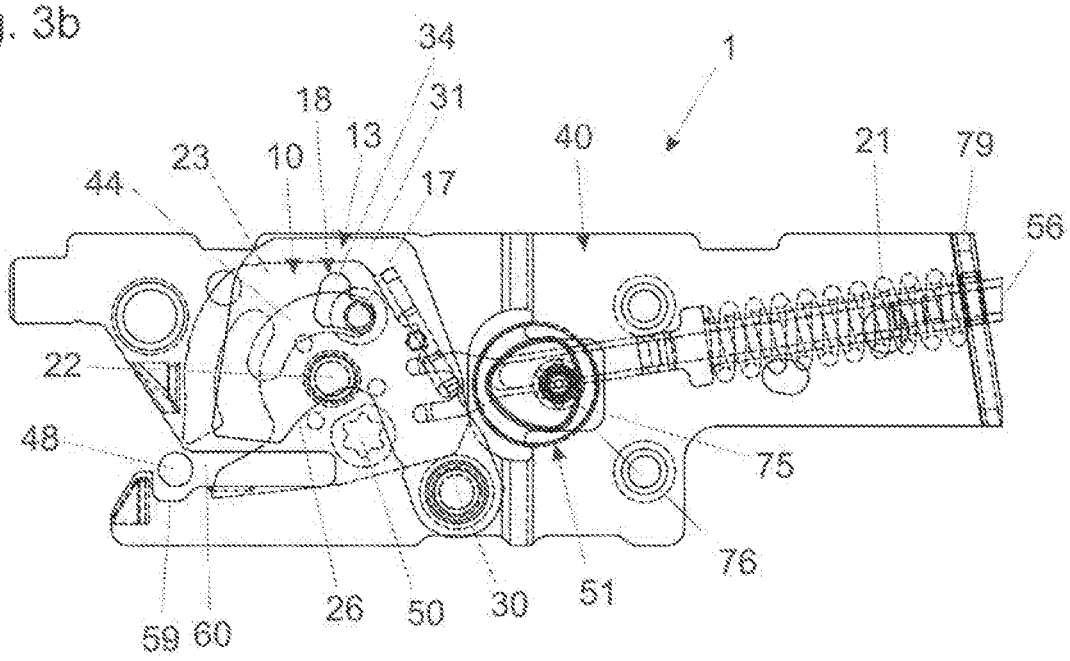

The mode of operation of the securing device 1 according to the first embodiment will now be described with reference to FIGS. 3*a* to 6*b*, wherein those Figures show the components which can be seen in a plan view from the side in solid lines and the respective components arranged on the opposite side in broken lines so that the cooperation of all components can be better appreciated: FIGS. 3*a* and 3*b* show the securing device 1 according to the first embodiment directly before insertion of the furniture fitting 8 or the transverse pin 48. The catch device 10 is in a readiness position in which the catch device 10 is ready to receive the furniture fitting 8. At the same time the locking device 13 is in a release position in which the furniture fitting 8 is moveable freely with respect to the locking device 13.

The catch lever 23 is disposed in a beyond dead point position relative to the axis of rotation 22 and the support point 79 on the mounting plate 40. The adjusting body 17 holds the locking lever 31 in the release position by way of the adjusting contour 18.

The transverse pin 48 of the furniture fitting 8 is arranged at the height of the engagement contour 59 of the guide contour 60.

Starting from FIGS. 3*a* and 3*b* a user now moves the front panel 5 and therewith the furniture fitting 8 or the transverse pin 48 in the direction of the drawer 6. In that situation the catch device 10 receives the furniture fitting 8 or the transverse pin 48. The catch lever 23 is moved out of the beyond dead point position beyond the dead centre point, whereby the force stored in the compression spring 21 can be liberated and the catch lever 23 can automatically move further. As a result the furniture fitting 8 or the transverse pin 48 is further moved inwardly along the guide contour 60. In other words the catch device 10 automatically pulls the furniture fitting 8 towards the drawer 6. In that situation the catch device 10 passes through a series of drive positions.

Figure 4A:
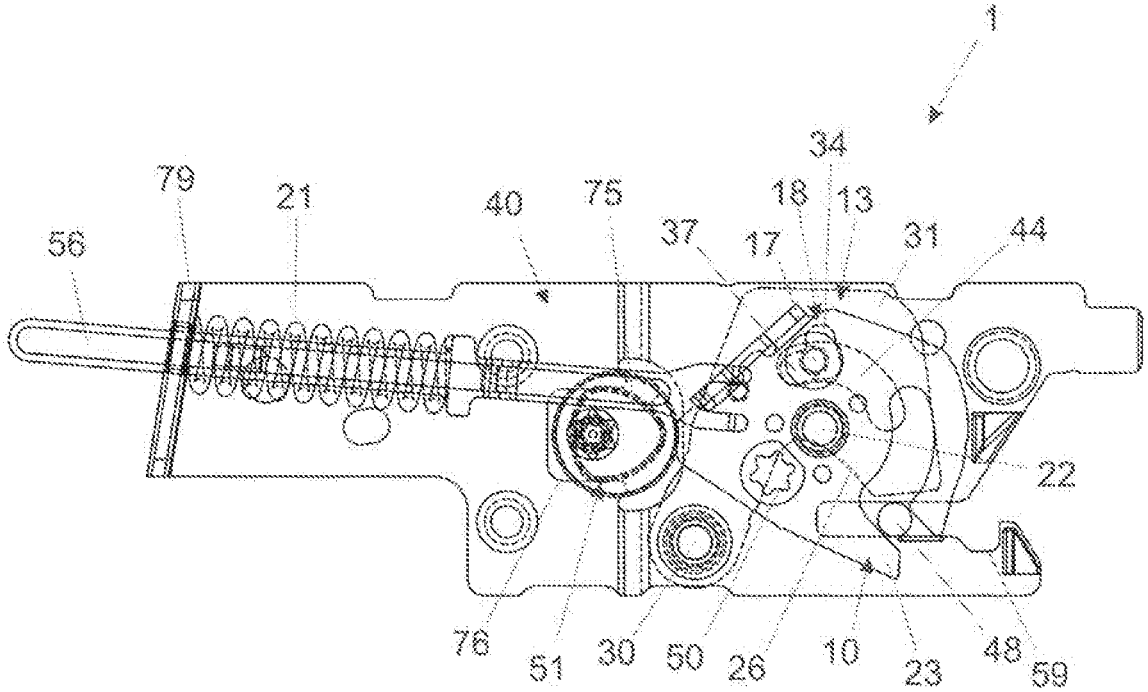
FIGS. 4*a*, 4*b* show a part of the securing device according to the first embodiment as a plan view from a first side (FIG. 4*a*) and from a second opposite side (FIG. 4*b*) in a first position upon insertion of a furniture fitting.
Figure 4B:
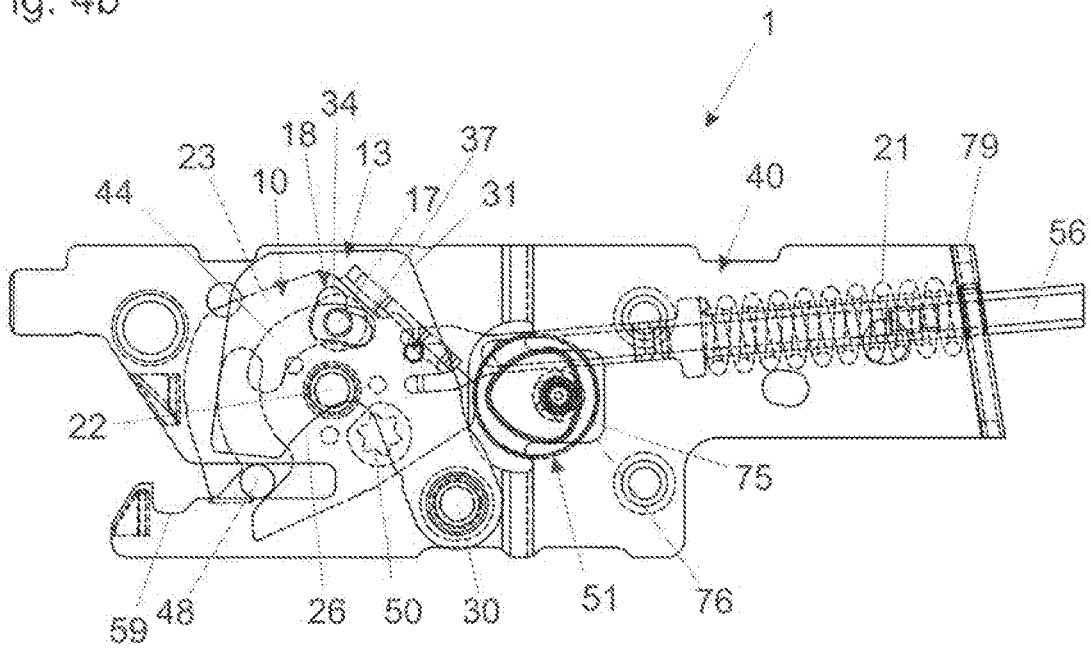
Figure 5A:
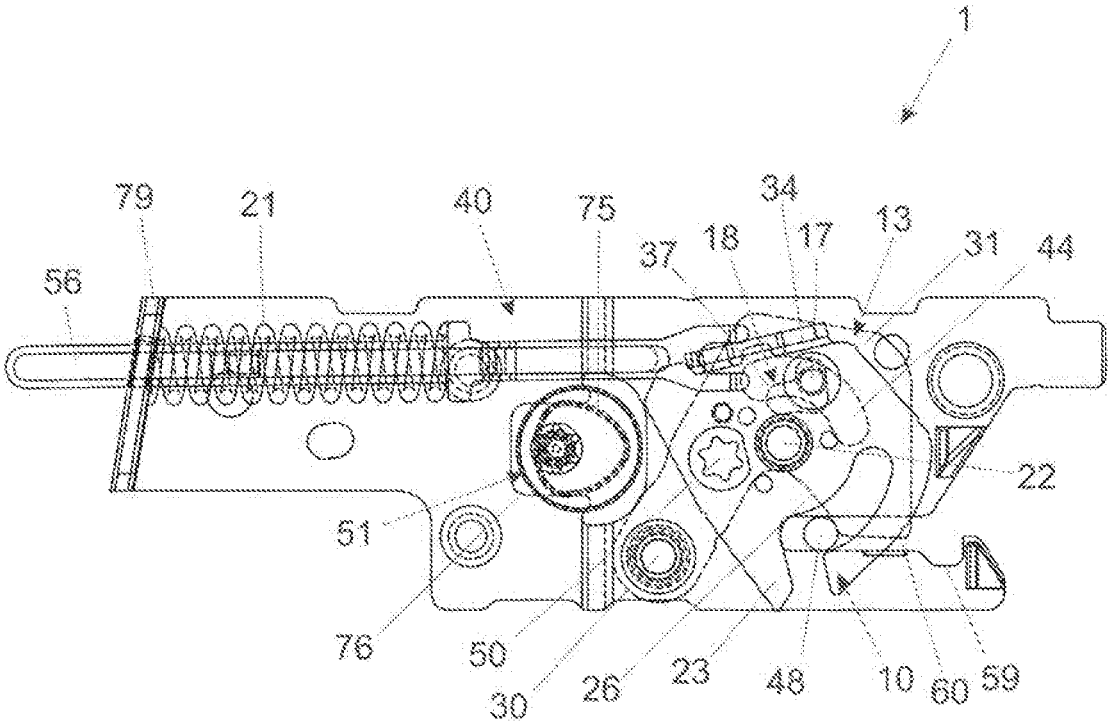
FIGS. 5*a*, 5*b* show a part of the securing device according to the first embodiment as a plan view from a first side (FIG. 5*a*) and from a second opposite side (FIG. 5*b*) in a second position upon insertion of a furniture fitting.
Figure 5B:
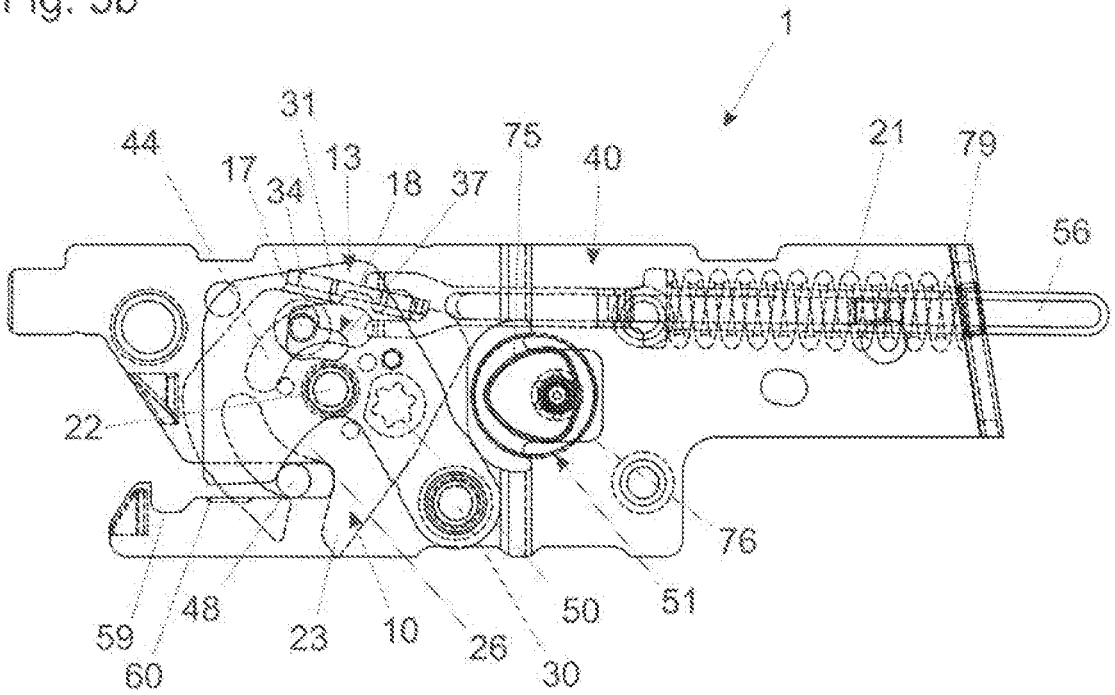

If FIGS. 3*a* and 3*b* are compared to FIGS. 4*a* and 4*b*, it is to be noted that the position of the locking lever 31 has not changed. That is because the adjusting body 17 has moved along in an uncoupling portion 37 of the adjusting contour 18. For that purpose, the uncoupling portion 37 is of a substantially circular configuration on a notional circle about the axis of rotation 22. The adjusting contour 18 is therefore of such a configuration that the movement of the locking device 13 upon insertion of the furniture fitting 8 is initially uncoupled from the movement of the catch device 10. Therefore no forces have to be applied for moving the locking lever 31.

Starting from the position shown in FIGS. 4*a* and 4*b*, the adjusting body 17 now moves into a coupling portion 34 of the adjusting contour 18 (see FIGS. 5*a* and 5*b*), that is to say the movement of the locking device 13 is now coupled to the movement of the catch device 10.

In that case the transverse pin 48 or the furniture fitting 8 is further pulled towards the drawer 6 by the catch lever 23 of the catch device 10. At the same time, the locking lever 31 now begins to pivot down behind the transverse pin 48 about the pivot point 30 and close the guide contour 60.

Figure 6A:
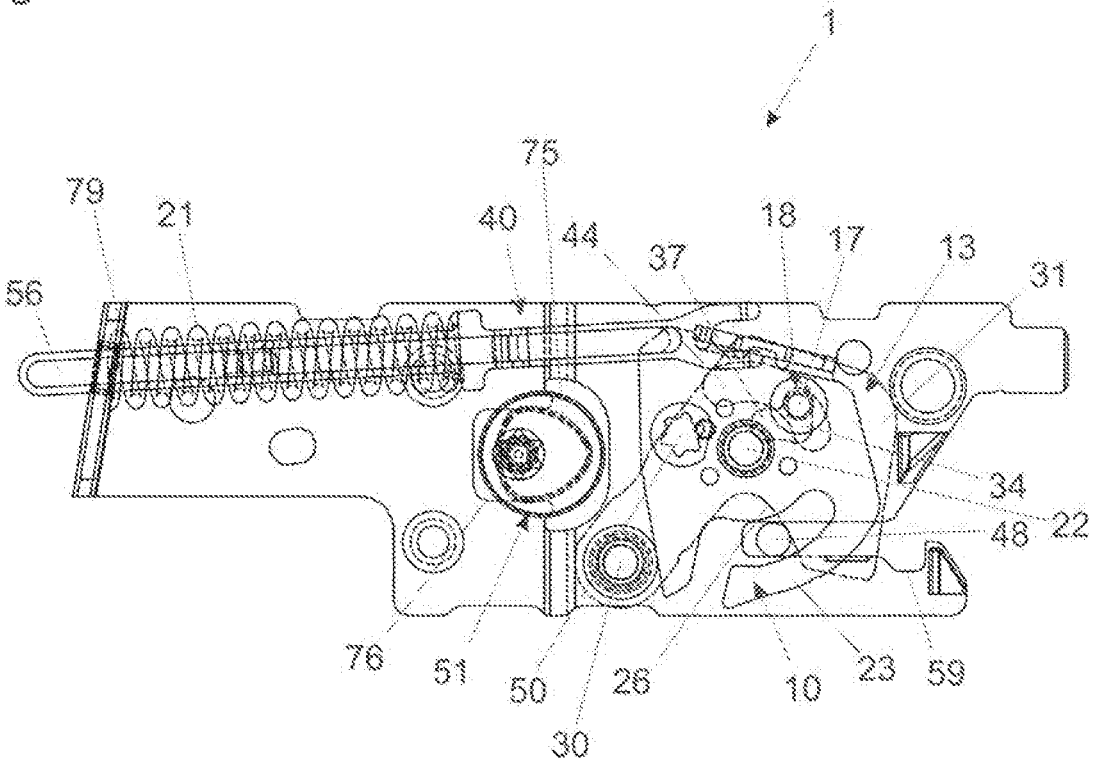
FIGS. 6*a*, 6*b* show a part of the securing device according to the first embodiment as a plan view from a first side (FIG. 6*a*) and from a second opposite side (FIG. 6*b*) in a position in which the front panel is approaching the drawer side wall.
Figure 6B:
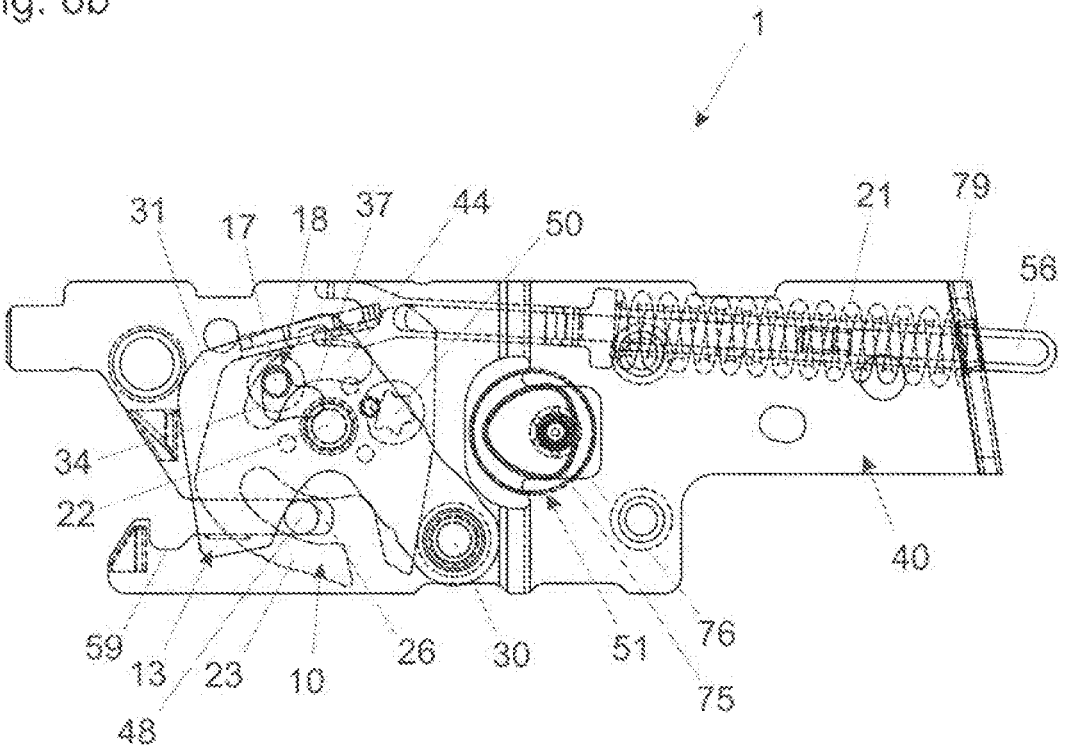
Figure 7A:
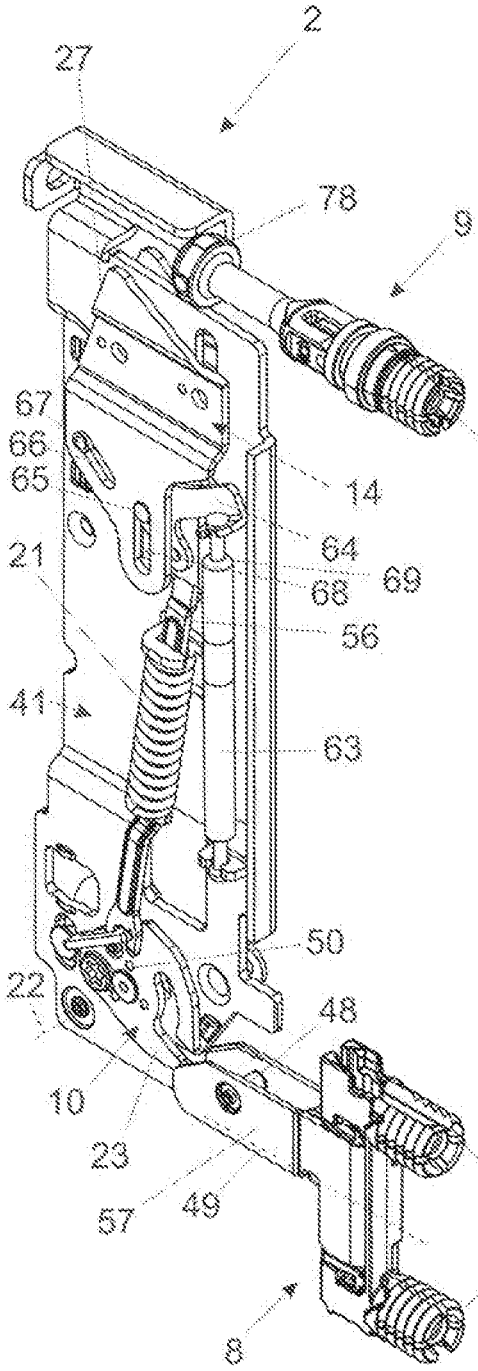
FIGS. 7*a*, 7*b* show a second embodiment of the securing device as a perspective view from a first side (FIG. 7*a*) and from a second opposite side (FIG. 7*b*) in a position prior to insertion of the furniture fittings.
Figure 7B:
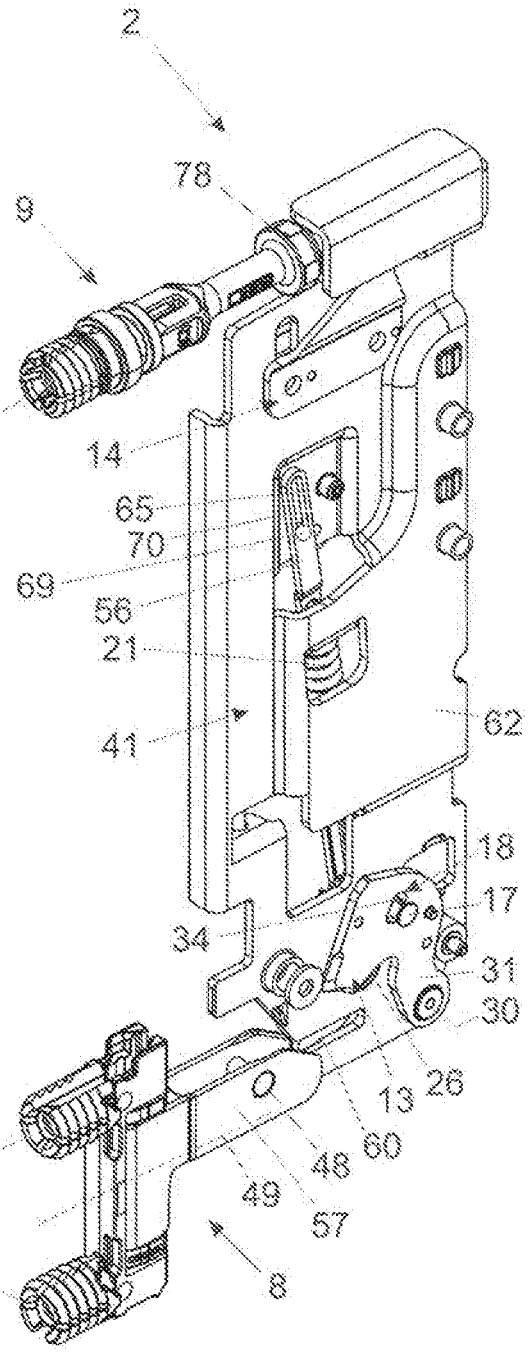

Those movements take place until the front panel 5 comes to bear against the drawer side wall 7, which is the case in the position of the securing device 1 shown in FIGS. 6*a* and 6*b*. In that position the locking lever 31 has clamped the transverse pin 48 by way of a curved locking contour 26. Unintentional release of the furniture fitting 8 from the securing device 1 is prevented thereby. The locking device 13 assumes a locking position.

If the intention is to release the furniture fitting 8 from the securing device 1 again, then the unlocking device 50 can be used for that purpose, which in the illustrated embodiment is in the form of a tool receiving means for a tool on the catch lever 23. By inserting the tip of a suitably designed screwdriver the catch lever 23 can be moved into the original readiness position again. In that case the locking device 13 is simultaneously moved out of the locking position into the release position by way of the coupling device 17, 18, in which case here too only temporary coupling of the movement of the catch device to the movement of the locking device occurs.

FIGS. 7*a* to 9*b* show a second embodiment of a securing device 2 for releasably securing a front panel 5 to a drawer 6. This embodiment is used in particular in relation to high front panels 5. For that purpose, there are provided two furniture fittings 8 and 9 which are arranged in mutually superposed relationship in height and which can be premounted to the front panel 5.

The lower part of the securing device 2 that co-operates with the furniture fitting 8, is substantially identical to the above-described first embodiment. In addition, however, there is also a further locking device 14 for the furniture fitting 9, wherein the movement of the locking device 14 is coupled to the movement of the catch device 10 or the locking device 13 for the lower furniture fitting 8.

The spring guide 56 is used for the movement coupling effect. More specifically the spring guide 56 includes a guide track 70 in which a pivot point 69 of an intermediate lever 46 is displaceably mounted. The intermediate lever 46 is mounted pivotably about a pivot point 65 on the mounting plate 41 of the securing device 2. The locking device 14 is linearly displaceable relative to the mounting plate 41. The intermediate lever 64 co-operates with the locking device 14 on the one hand by way of the pivot point 65 in the form of a pin and on the other hand by way of a further pin 67 arranged on the intermediate lever 64. The pins 65 and 67 engage into guide tracks 68 and 66 provided in the locking device 14.

The locking device 14 has a locking contour 27 for the furniture fitting 9, the locking contour in this case being a linear configuration.

Besides, the spring 21 the intermediate lever 64 is also acted upon by a tension spring 63.

Reference should also be made to a cover plate 62 arranged on the mounting plate 41.

In comparison with the furniture fitting 8 the furniture fitting 9 has only one securing element 47. In addition, the furniture fitting 9 co-operates with the securing device 2 not by way of a transverse pin 48 but by way of a trunnion 78.

Figure 8A:
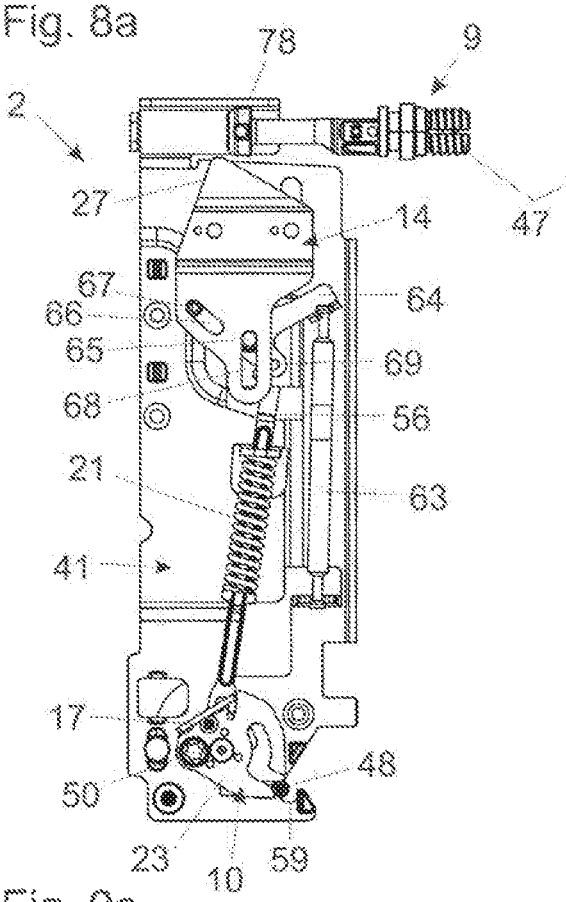
FIGS. 8*a*, 8*b* show a part of the securing device according to the second embodiment in a plan view from a first side (FIG. 8*a*) and from a second opposite side (FIG. 8*b*) in a first position upon insertion of the furniture fittings.
Figure 8B:
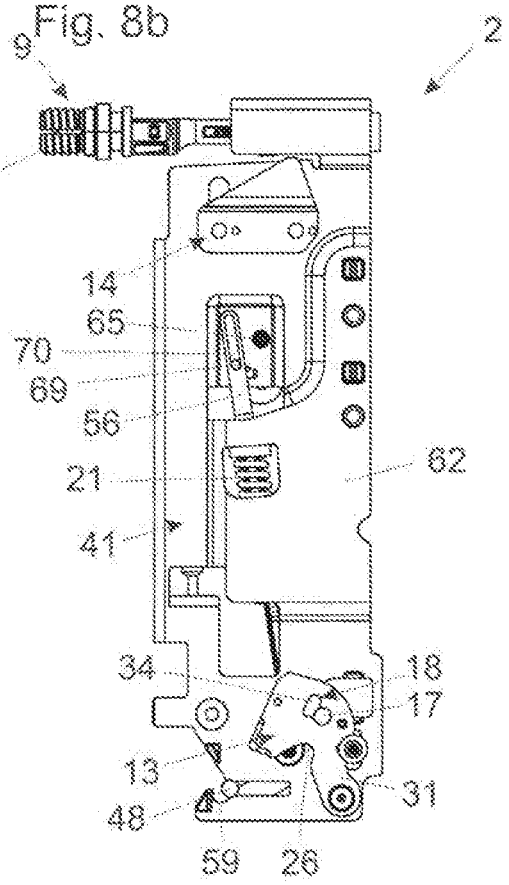
Figure 9A:
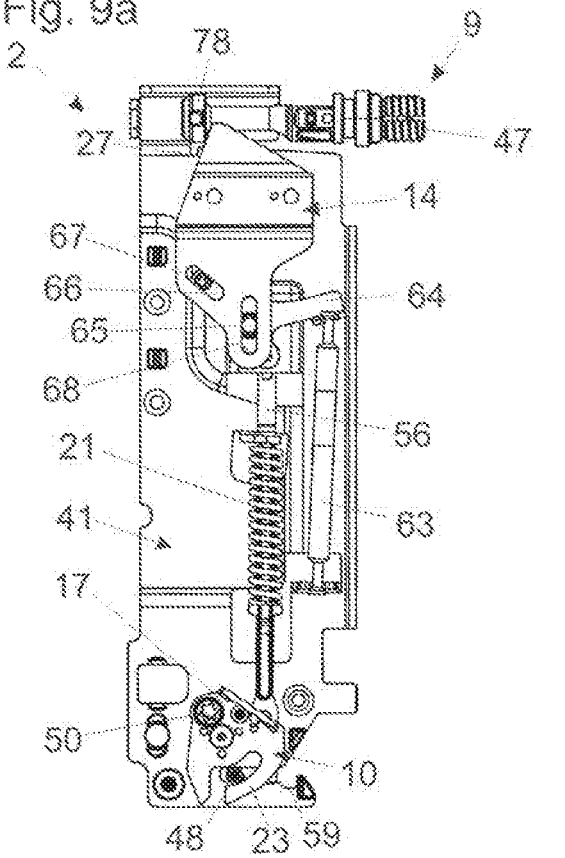
FIGS. 9*a*, 9*b* show a part of the securing device according to the second embodiment as a plan view from a first side (FIG. 9*a*) and from a second opposite side (FIG. 9*b*) in a position in which the front panel is approaching the drawer side wall.
Figure 9B:
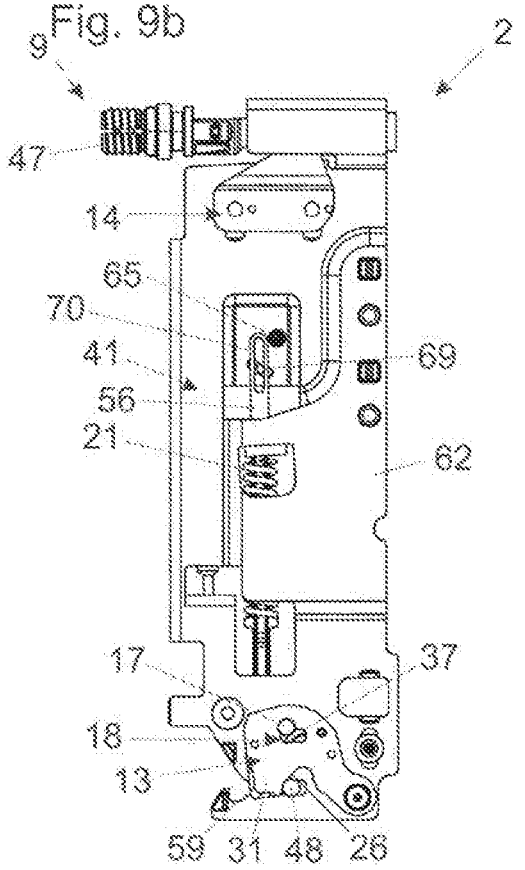
Figure 10A:
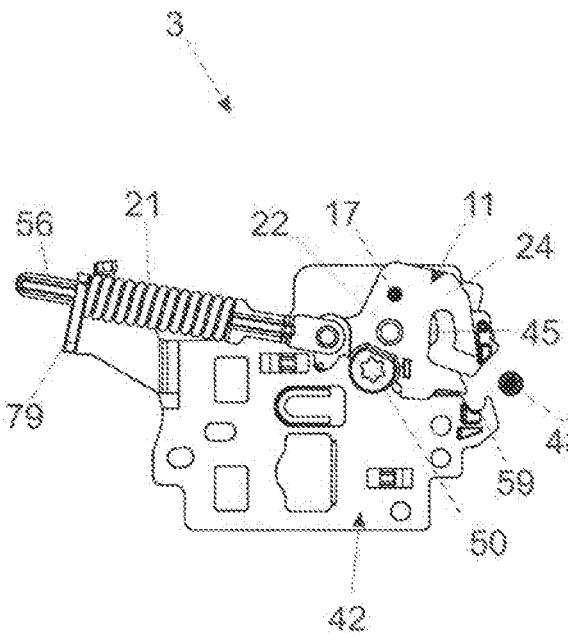
FIGS. 10*a*, 10*b* show a part of the securing device according to the third embodiment as a plan view from a first side (FIG. 10*a*) and from a second opposite side (FIG. 10*b*) in a position prior to insertion of a furniture fitting.
Figure 10B:
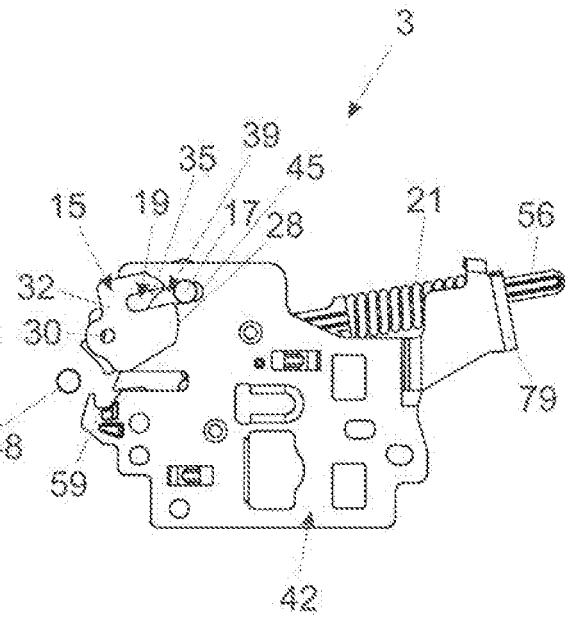
Figure 11A:
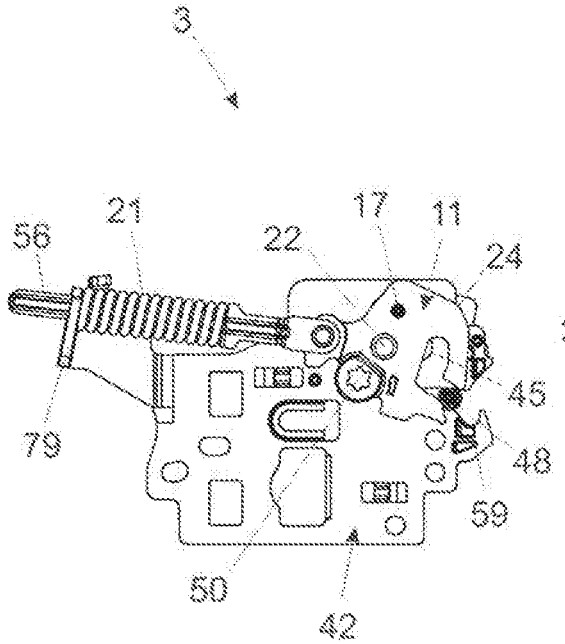
FIGS. 11*a*, 11*b* show a part of the securing device according to the third embodiment as a plan view from a first side (FIG. 11*a*) and from a second opposite side (FIG. 11*b*) in a first position upon insertion of a furniture fitting.
Figure 11B:
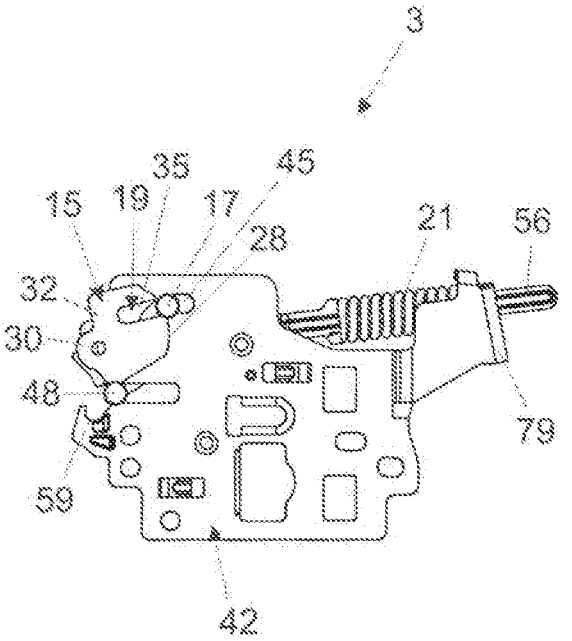
Figure 12A:
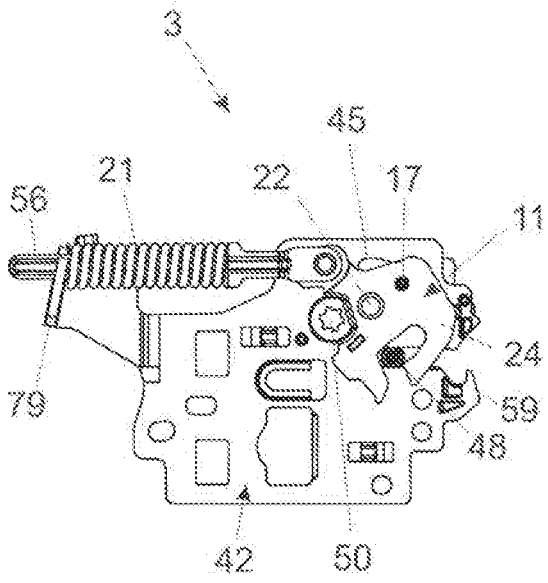
FIGS. 12*a*, 12*b* show a part of the securing device according to the third embodiment as a plan view from a first side (FIG. 12*a*) and from a second opposite side (FIG. 12*b*) in a second position upon insertion of a furniture fitting.
Figure 12B:
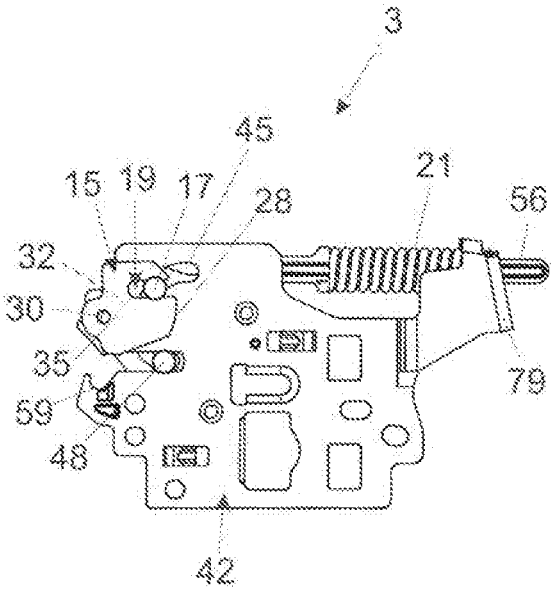
Figure 13A:
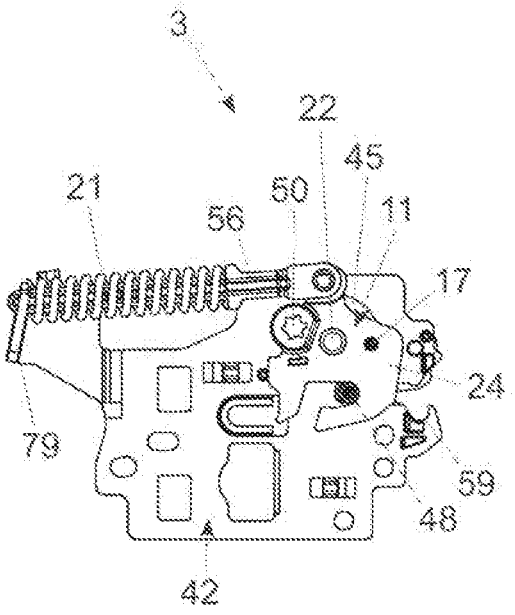
FIGS. 13*a*, 13*b* show a part of the securing device according to the third embodiment as a plan view from a first side (FIG. 13*a*) and from a second opposite side (FIG. 13*b*) in a position in which the front panel is approaching the drawer side wall.
Figure 13B:
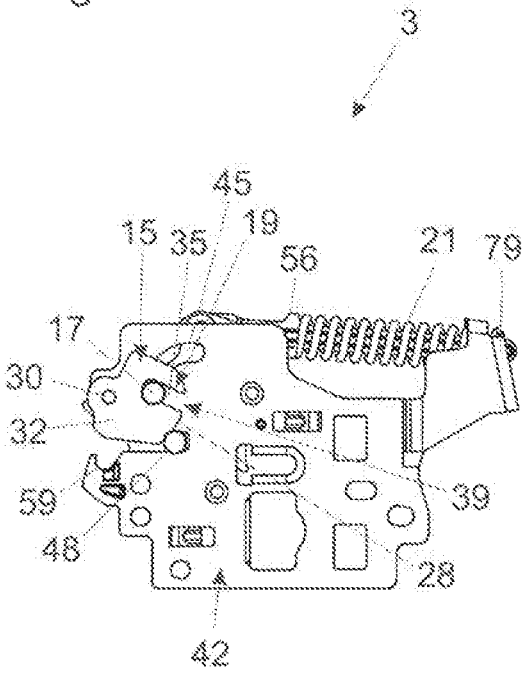
Figure 14A:
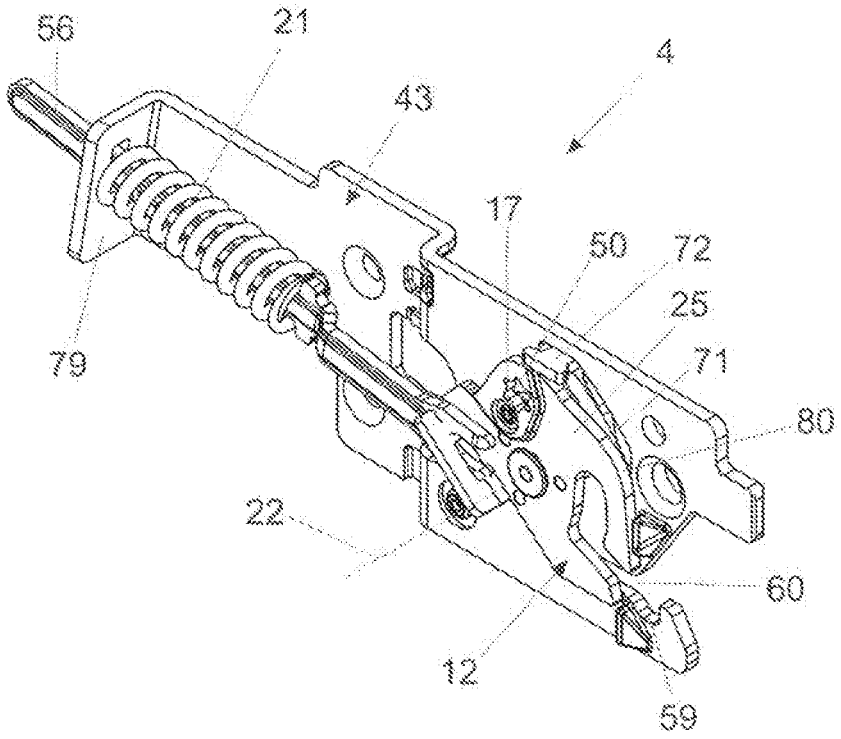
FIGS. 14*a*, 14*b* show a fourth embodiment of the securing device as a perspective view from a first side (FIG. 14*a*) and from a second opposite side (FIG. 14*b*) in a position prior to insertion of the furniture fittings.
Figure 14B:
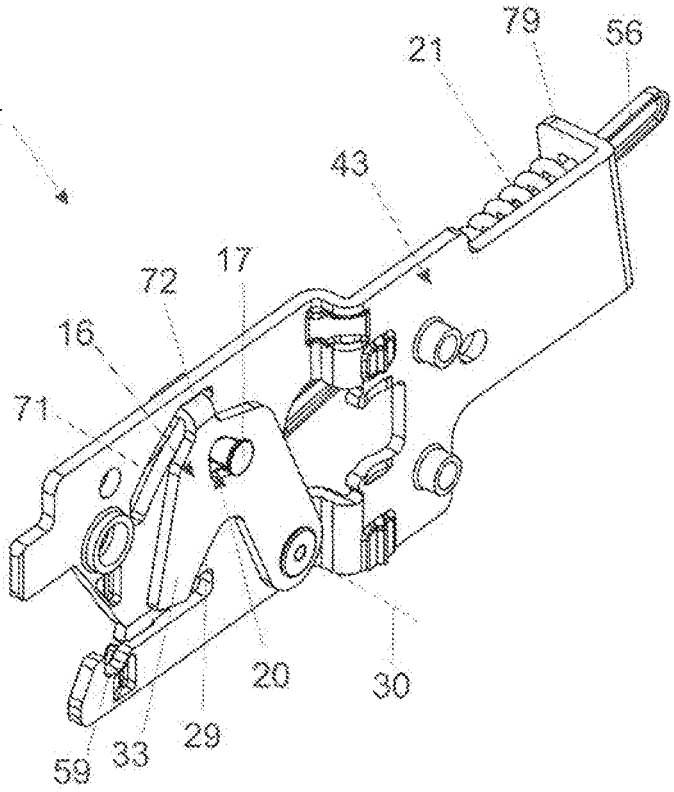
Figure 15A:
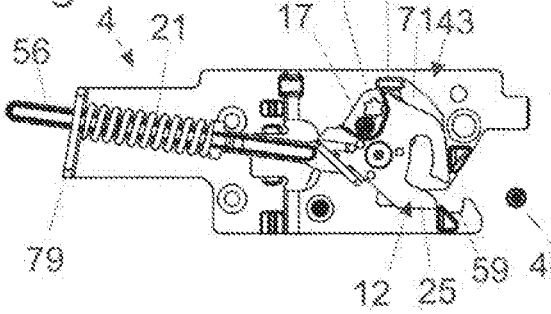
FIGS. 15*a*, 15*b* show a part of the securing device according to the fourth embodiment as a plan view from a first side (FIG. 15*a*) and from a second opposite side (FIG. 15*b*) in a position prior to insertion of a furniture fitting.
Figure 15B:
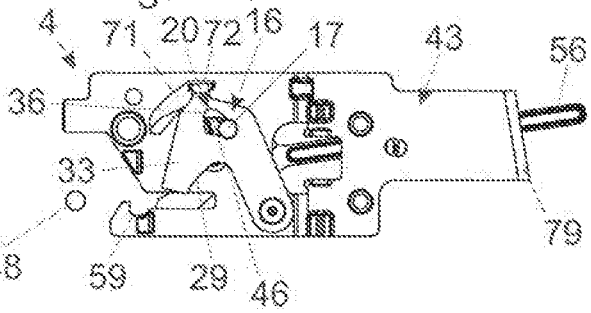
Figure 16A:
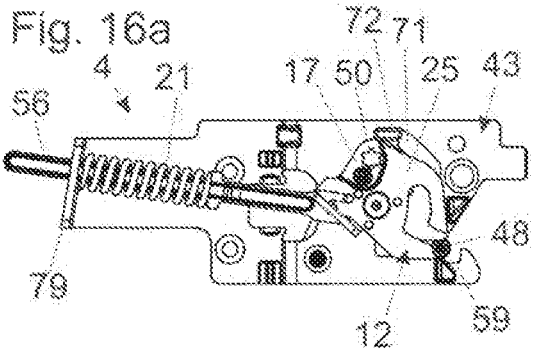
FIGS. 16*a*, 16*b* show a part of the securing device according to the fourth embodiment as a plan view from a first side (FIG. 16*a*) and from a second opposite side (FIG. 16*b*) in a first position upon insertion of a furniture fitting.
Figure 16B:
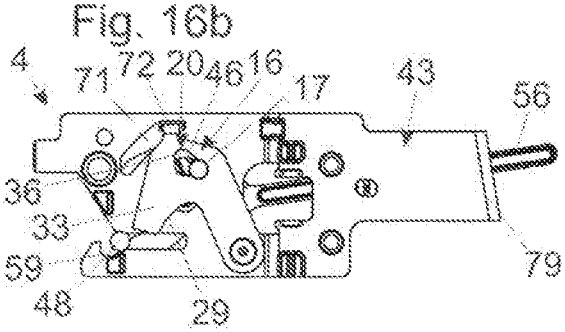
Figure 17A:
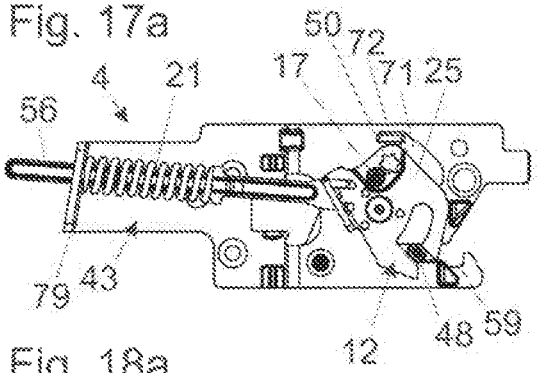
FIGS. 17*a*, 17*b* show a part of the securing device according to the fourth embodiment as a plan view from a first side (FIG. 17*a*) and from a second opposite side (FIG. 17*b*) in a second position upon insertion of a furniture fitting.
Figure 17B:
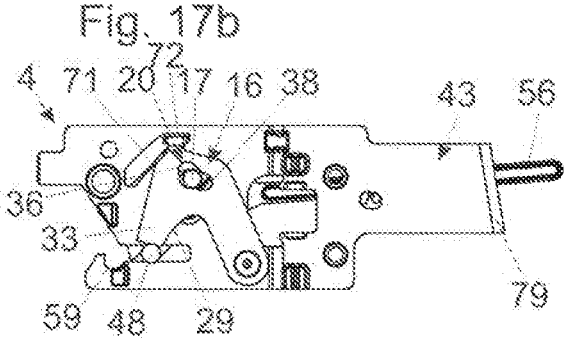
Figure 18A:
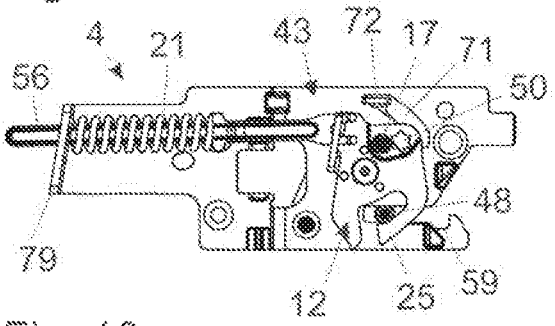
FIGS. 18*a*, 18*b* show a part of the securing device according to the fourth embodiment as a plan view from a first side (FIG. 18*a*) and from a second opposite side (FIG. 18*b*) in a third position upon insertion of a furniture fitting.
Figure 18B:
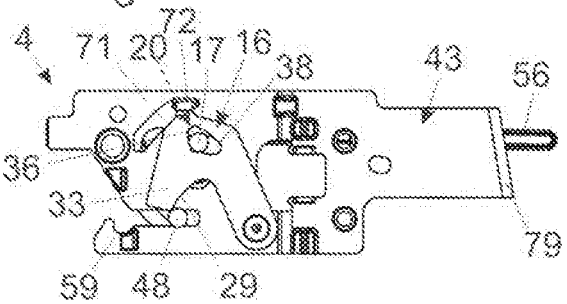
Figure 19A:
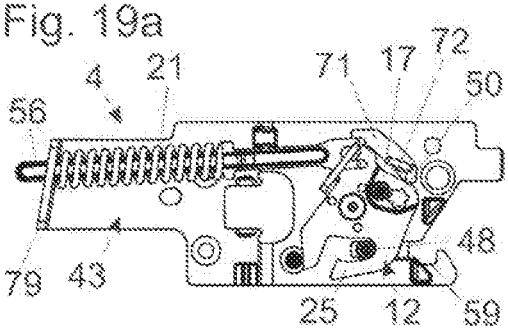
FIGS. 19*a*, 19*b* show a part of the securing device according to the fourth embodiment as a plan view from a first side (FIG. 19*a*) and from a second opposite side (FIG. 19*b*) in a position in which the front panel is approaching the drawer side wall.
Figure 19B:
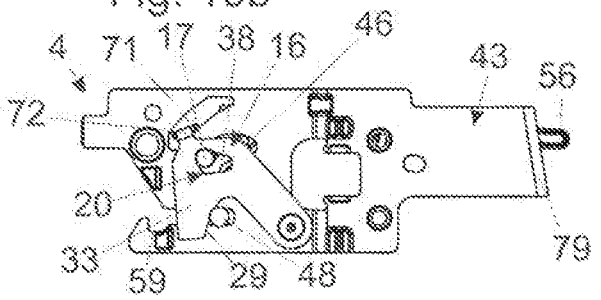
Figure 20A:
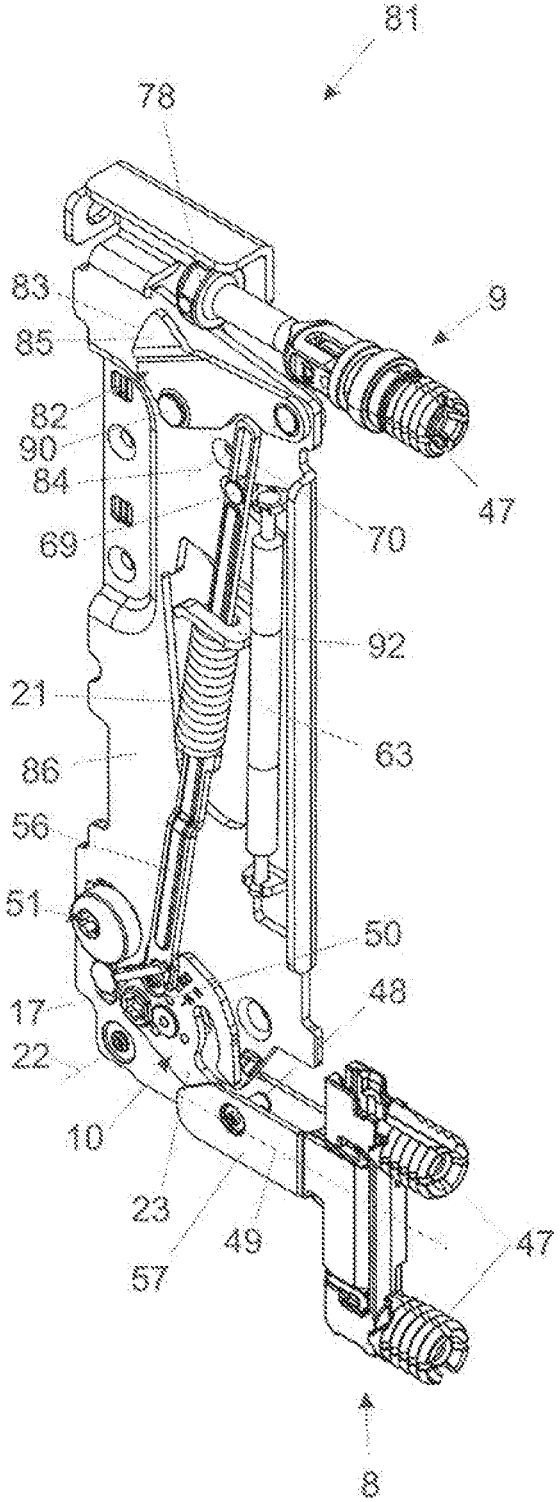
FIGS. 20*a*, 20*b* show a fifth embodiment of the securing device as a perspective view from a first side (FIG. 20*a*) and from a second opposite side (FIG. 20*b*) in a position prior to insertion of the furniture fittings.
Figure 20B:
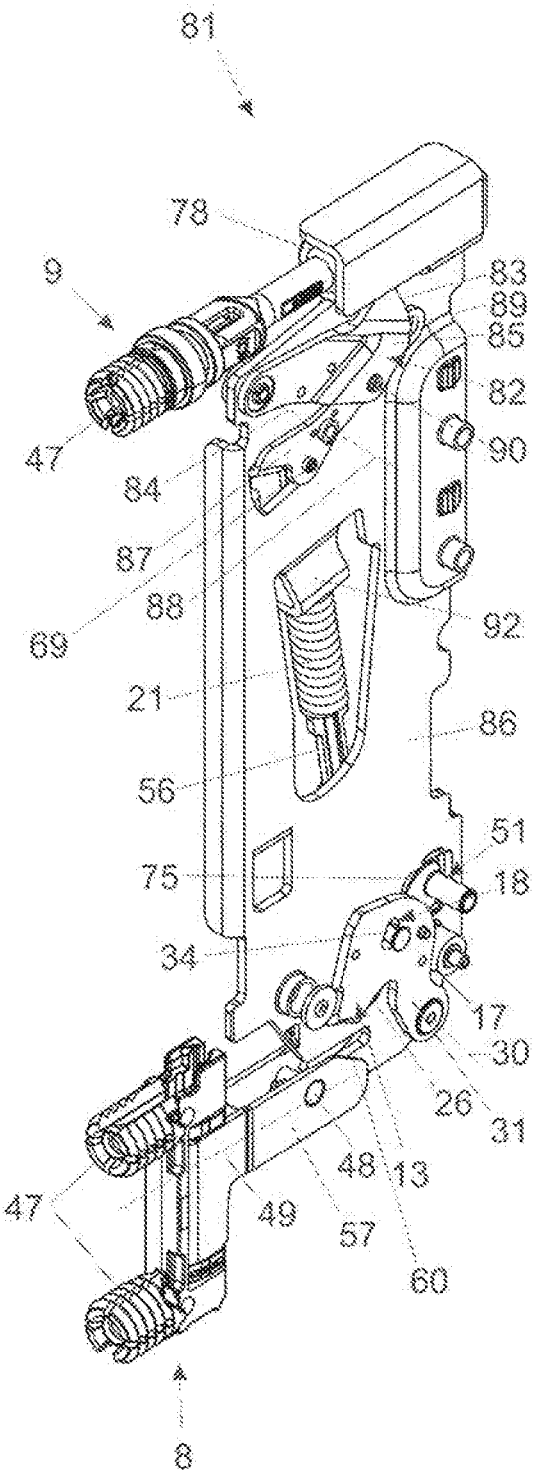
Figure 21A:
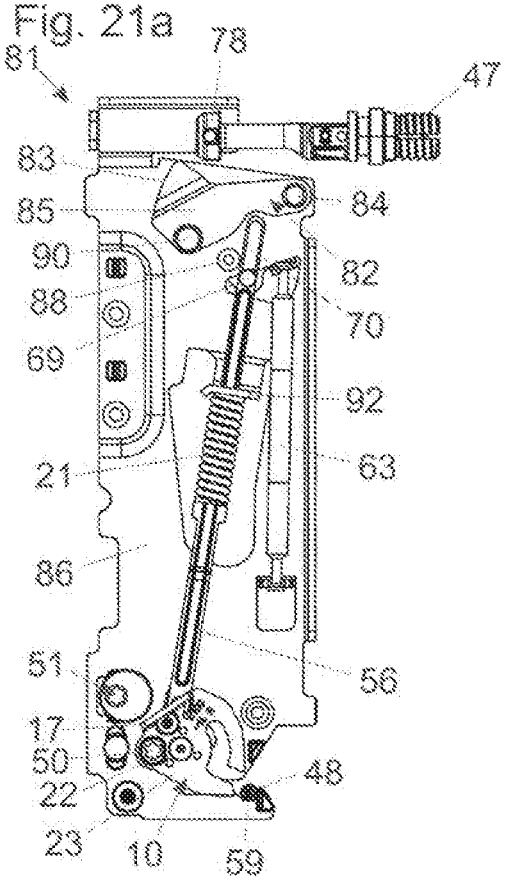
FIGS. 21*a*, 21*b* show a part of the securing device according to the fifth embodiment as a plan view from a first side (FIG. 21*a*) and from a second opposite side (FIG. 21*b*) in a first position upon insertion of the furniture fittings.
Figure 21B:
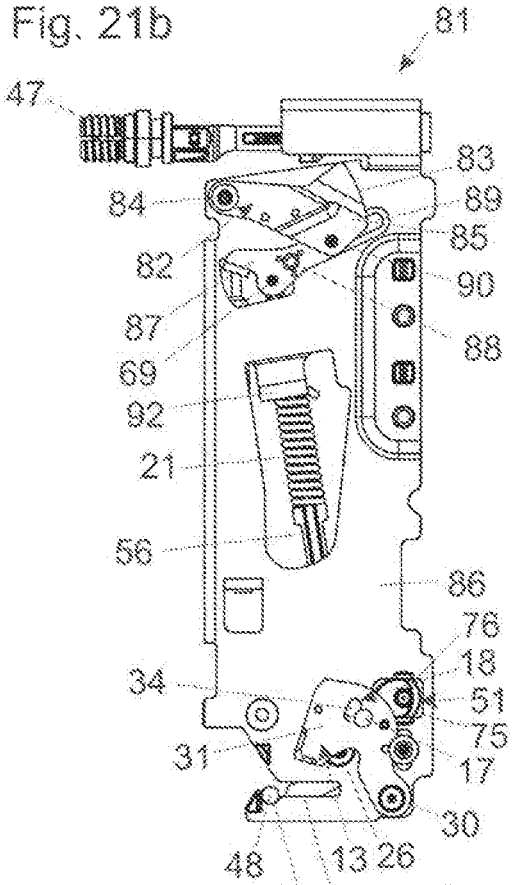
Figure 22A:
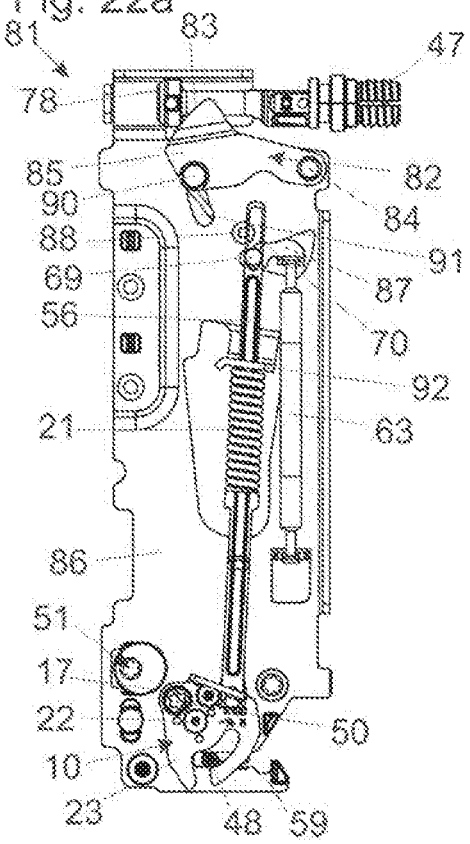
FIGS. 22*a*, 22*b* show a part of the securing device according to the fifth embodiment as a plan view from a first side (FIG. 22*a*) and from a second opposite side (FIG. 22*b*) in a position in which the front panel is approaching the drawer side wall.
Figure 22B:
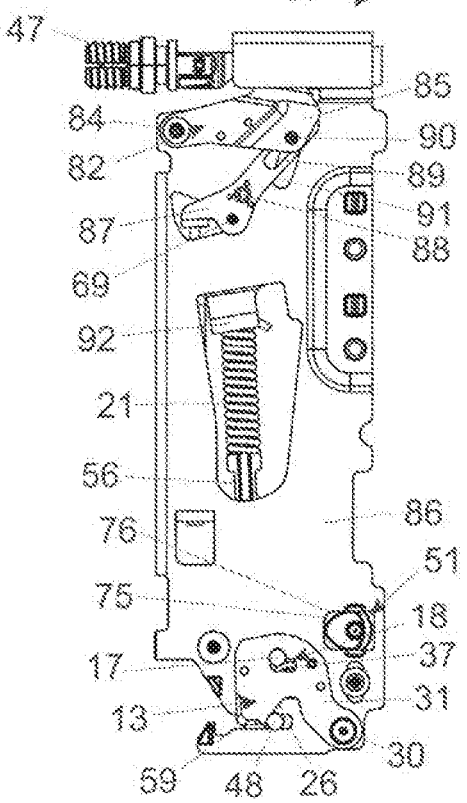

As can be seen in particular from a comparison of FIGS. 8*a* and 8*b* with FIGS. 9*a* and 9*b*, upon a movement of the catch lever 23 of the catch device 10 the locking device 14 is urged upwardly by way of the spring guide 56 functioning as a transmission lever, the springs 21 and 63, the intermediate lever 64 and the pins 65 and 67 mounted in the guide tracks 66 and 68. In that case the furniture fitting 9 or the trunnion 78 is locked by the locking contour 27 so that the locking device 14 prevents unintentional release of the furniture fitting 9 from the securing device 2.

The locking device 14 together with the locking device 13 can be moved back into the original release position again by way of the unlocking device 50 and the coupling mechanism 56, 64, 66, 68, 65, 67, 63 and 21 arranged between the catch device 10 and the locking device 14.

FIGS. 10*a* to 13*b* show a third embodiment of the securing device 3. The mode of operation of the securing device 3 substantially corresponds to that of the securing device 1 in the first embodiment.

A substantial difference lies in the configuration of the coupling device 17, 19 for coupling the movement of the locking device 15 or the locking lever 32 to the movement of the catch device 11 or the catch lever 24 respectively. Admittedly in this case the adjusting contour 19 has an open end 39 adjoining the coupling portion 35. When the adjusting body 17 is outside the adjusting contour 19 the movements are uncoupled from each other (compare FIGS. 10*a* to 11*b*). If the adjusting body 17 passes into the coupling portion 35 at the open end 39 and the adjusting body 17 moves along the coupling portion 35 then the movements are coupled together.

In this case locking of the transverse pin 48 is also effected by way of a curved locking contour 28 on the locking lever 32.

In this embodiment also the adjusting body 17 moves along a guide contour 45 provided in a mounting plate 42.

FIGS. 14*a* to 19*b* show a fourth embodiment of the securing device 4. The mode of operation of this securing device 4 substantially corresponds to that of the securing devices 1 and 3 of the first and third embodiments.

A particularity with this embodiment is that besides a guide contour 46 in a mounting plate 43 for guiding the adjusting body 17 there is also a catch lever adjusting contour 71 for guiding an entrainment portion 72 arranged on the catch lever 25 of the catch device 12.

The movement of the locking lever 33 of the locking device 16 and the movement of the catch lever 25 of the catch device 12 are coupled in this embodiment not only by way of the adjusting body 17 and the adjusting contour 20 which includes a coupling portion 36 and an uncoupling portion 38, but also, upon intentional release of the furniture fitting from the securing device 4, by means of the unlocking device 50, by way of the entrainment portion 72 which upon movement of the catch lever 25 out of the locking position into the readiness position, comes to bear against an outside contour 80 of the catch lever 25, whereby the locking lever 33 is also moved.

FIGS. 20*a* to 22*b* show a fifth embodiment of a securing device 81 according to the invention. This embodiment is very similar to the second embodiment. It differs in the configuration of the upper part for securing the furniture fitting 9. Upon insertion of the furniture fitting 8 the catch lever 23 of the catch device 10 is pivoted under the influence of the spring 21 from the beyond dead point position about the axis of rotation 22. In that case the spring guide 56 is also pivoted about the support point 92. Arranged at the end of the spring guide 56 is a guide track 70 in which a pivot point 69 of intermediate lever 87 is movably mounted. By virtue of the pivotal movement of the spring guide 56 the intermediate lever 87 is tilted about the pivot point 88. As a result subsequently a locking lever 85 of a locking device 82 is pivoted about an axis of rotation 84 by way of a pin 90 mounted in a guide track 89 so that the locking lever 85 comes into contact with a curved locking contour 83 on the trunnion 78 of the furniture fitting 9. The pin 90 is arranged on the locking lever 85 and the guide track 89 on the intermediate lever 87. The pin 90 is guided at the same time by a guide track 91 in the mounting plate 86.

The tension spring 63 is stressed in the movement of the locking lever 85 out of the release position into the locking position. The force stored in that situation in the tension spring 63 supports the reversed movement of the locking lever 85 out of the locking position into the release position upon intentional release of the furniture fittings 8 and 9 from the securing device 81 by means of the unlocking device 50.

The invention claimed is:

1. A securing device configured for detachably securing a front panel to a drawer, the securing device comprising:

at least one furniture fitting configured to be pre-mounted to the front panel;

at least one catch device configured to be associated with the drawer and receive the at least one furniture fitting, wherein the at least one catch device, upon insertion of the at least one furniture fitting is configured to automatically pull the at least one furniture fitting;

at least one locking device configured to prevent unintentional detachment of the at least one furniture fitting from the securing device; and a coupling device for coupling movement of the at least one locking device to movement of the at least one catch device, wherein the coupling device has at least one adjusting body and at least one adjusting contour, in or on which the at least one adjusting body is or can be arranged, wherein the at least one adjusting body is arranged on the at least one catch device and the at least one adjusting contour is arranged on the at least one locking device, or vice-versa, wherein the at least one adjusting contour is configured such that the movement of the at least one locking device is initially uncoupled from the movement of the at least one catch device upon insertion of the at least one furniture fitting, wherein the at least one locking device is moveable into: (i) a release position in which the at least one furniture fitting is freely moveable with respect to the at least one locking device; and (ii) a locking position in which unintentional detachment of the at least one furniture fitting from the securing device is prevented, and wherein the at least one locking device has a locking lever pivotable about an axis of rotation.

2. The securing device according to claim 1, further comprising at least one spring, wherein the at least one catch device, upon insertion of the at least one furniture fitting, is configured to automatically pull the at least one furniture fitting by force of the at least one spring.

3. The securing device according to claim 1, wherein the at least one catch device is moveable into: (i) a readiness position in which the at least one catch device is ready to receive the at least one furniture fitting upon insertion thereof; and (ii) at least one drive position in which the at least one catch device is configured to pull the at least one furniture fitting after the at least one furniture fitting has been received therein, optionally wherein the at least one catch device has a catch lever pivotable about an axis of rotation.

4. The securing device according to claim 1, wherein the at least one locking device includes a locking contour which can be arranged on the at least one furniture fitting to prevent unintentional detachment of the at least one furniture fitting from the securing device, optionally wherein the locking contour is curved, and optionally wherein the at least one furniture fitting can be clamped by the locking contour.

5. The securing device according to claim 1, wherein the at least one adjusting body includes a pin, optionally with an enlarged head.

6. The securing device according to claim 1, wherein the at least one adjusting contour has at least one coupling portion, by which the movement of the at least one locking device, upon insertion of the at least one furniture fitting, can be coupled to the movement of the at least one catch device.

7. The securing device according to claim 6, wherein:

the at least one adjusting contour has at least one uncoupling portion, separate from the at least one coupling portion, for uncoupling the movement of the at least one locking device from the movement of the at least one catch device upon insertion of the at least one furniture fitting, optionally wherein the at least one coupling portion and the at least one uncoupling portion are angled relative to each other; or the at least one adjusting contour has an open end adjoining the at least one coupling portion.

8. The securing device according to claim 1, further comprising at least one mounting plate, and at least one guide contour defined in the at least one mounting plate, wherein the at least one adjusting body is mounted displaceably in or on the at least one guide contour.

9. The securing device according to claim 1, wherein the at least one furniture fitting has at least one securing element for mounting the at least one furniture fitting to the front panel, and/or a transverse pin or a projection configured to cooperate with the at least one catch device and/or the at least one locking device.

10. The securing device according to claim 1, wherein the at least one furniture fitting is asymmetrical in relation to a notional central plane.

11. The securing device according to claim 1, further comprising:

an unlocking device for the at least one locking device, which is configured to permit intentional release of the at least one furniture fitting from the securing device, wherein the unlocking device is configured to withdraw the at least one locking device from the at least one furniture fitting and release the at least one furniture fitting, optionally wherein the unlocking device has a tool receiving portion accessible from an exterior for a tool, the unlocking device being actuable by the tool receiving portion; and/or a height adjusting device and/or a side adjusting device for the front panel.

12. An arrangement comprising a drawer, a front panel and at least one securing device according to claim 1, optionally wherein the drawer includes an at least region-wise hollow drawer side wall and the at least one securing device is arranged predominantly in the at least one drawer side wall.

13. An article of furniture comprising at least one arrangement according to claim 12.

14. A method of securing a front panel to a drawer using at least one securing device according to claim 1, the method comprising:

in a first method step, mounting the at least one furniture fitting to the front panel;

in a second method step, receiving the at least one furniture fitting by the at least one catch device and automatically pulling the at least one furniture fitting towards the drawer, wherein the movement of the at least one catch device and the movement of the at least one locking device are initially uncoupled and are then coupled together by the coupling device; and in a third method step, preventing unintentional detachment of the at least one furniture fitting from the securing device by the at least one locking device.

* * * * *